US010792556B2

(12) United States Patent
Furuta et al.

(10) Patent No.: US 10,792,556 B2
(45) Date of Patent: Oct. 6, 2020

(54) BASEBALL GAME BOARD

(71) Applicant: EPOCH COMPANY, LTD., Tokyo (JP)

(72) Inventors: Nozomu Furuta, Tokyo (JP); Tsutomu Okada, Kanagawa (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 16/378,811

(22) Filed: Apr. 9, 2019

(65) Prior Publication Data

US 2019/0308093 A1 Oct. 10, 2019

(30) Foreign Application Priority Data

Apr. 10, 2018 (JP) ..... 2018-075658

(51) Int. Cl.
*A63F 3/00* (2006.01)
*A63F 7/06* (2006.01)

(52) U.S. Cl.
CPC ..... *A63F 7/0608* (2013.01); *A63F 3/00031* (2013.01); *A63F 2003/00034* (2013.01)

(58) Field of Classification Search
CPC ..... A63F 7/0608; A63F 3/00031; A63F 2003/00034
USPC ..... 273/317.6, 317.7, 317.9, 108.3, 108.31, 273/108.32, 129 S, 129 T, 129 V, 129 W, 273/129 R, 119 R
See application file for complete search history.

(56) References Cited

U.S. PATENT DOCUMENTS 1,896,684 A * 2/1933 Cutting ..... A63F 7/0608 273/108.31
1,942,429 A * 1/1934 Jacobs ..... A63F 7/0608 273/108.31
1,966,748 A * 7/1934 Allen ..... G07F 17/38 124/6
2,682,409 A * 6/1954 Irwin ..... A63F 7/0608 273/121 R
2,775,457 A * 12/1956 Galbos ..... A63F 7/0608 273/108.31

(Continued)

FOREIGN PATENT DOCUMENTS

JP S26-005333 5/1951
JP S47-030536 9/1972

(Continued)

OTHER PUBLICATIONS

JP Office Action dated Feb. 12, 2020 from corresponding Japanese patent application No. 2018-075658 (with attached English-language translation).

(Continued)

*Primary Examiner* — Vishu K Mendiratta
(74) *Attorney, Agent, or Firm* — Faegre Drinker Biddle & Reath LLP

(57) ABSTRACT

A baseball game board includes: a main body unit simulating a baseball stadium and including an upper surface plate; a pitching unit configured to pitch a ball to allow the ball to move while floating in air; a batting unit configured to hit the ball; and a selection unit configured to gradationally select a ball height of the ball at a time of passing through the batting unit. In accordance with a selection result of the selection unit, a trajectory of the ball shot from the pitching unit is changed.

4 Claims, 13 Drawing Sheets

(56) References Cited

U.S. PATENT DOCUMENTS

| | | | | | |
|---|---|---|---|---|---|
| 2,829,895 | A * | 4/1958 | Moen | A63F 7/0608 | 124/10 |
| 3,101,197 | A * | 8/1963 | Schulz | A63F 7/0608 | 273/317.7 |
| 3,706,454 | A * | 12/1972 | Parlato | A63F 7/0608 | 273/108.31 |
| 4,251,074 | A * | 2/1981 | Welker | A63F 7/0608 | 124/26 |
| 4,327,913 | A * | 5/1982 | Bock | A63F 7/0608 | 124/17 |
| 9,566,502 | B2 * | 2/2017 | Takagishi | A63F 7/0608 | |
| 2015/0202527 | A1 | 7/2015 | Takagishi et al. | | |

FOREIGN PATENT DOCUMENTS

| | | |
|---|---|---|
| JP | S49-016745 | 4/1974 |
| JP | UM-A-S53-156680 | 12/1978 |
| JP | UM-A-S56-075980 | 6/1981 |
| JP | 2009-082502 | 4/2009 |
| JP | 2016-128000 A | 7/2016 |

OTHER PUBLICATIONS

JP Office Action dated Apr. 21, 2020 from corresponding Japanese patent application No. 2018-075658 (with attached English-language translation).

JP Office Action dated Aug. 18, 2020 from corresponding Japanese patent application No. 2018- 075658 (with attached English-language translation).

* cited by examiner

BASEBALL GAME BOARD

CROSS-REFERENCES TO RELATED APPLICATIONS

This application is based on and claims priority from Japanese Patent Application No. 2018-075658 filed on Apr. 10, 2018, the entire contents of which are incorporated herein by reference.

FIELD

One or more embodiments of the present invention relate to a baseball game board for playing a game simulating a baseball game.

BACKGROUND

In the related art, as a table-type baseball game board, there is a baseball game board configured so that a baseball game can be played while a ball is pitched, batted, or caught on a board surface simulating a baseball stadium. The baseball game board configured in this way includes various mechanisms such as a pitching unit, a batting unit, and a catching unit. Furthermore, miniature dolls of a pitcher, a batter, a runner, and a fielder are deployed on the board surface.

One operator shoots the ball from the pitching unit toward the catching unit by operating a knob, and the other operator hits the shot ball by using the batting unit. In this way, the baseball game board in the related art is configured so that the operators can enjoy the game while simulating actual baseball rules.

In addition, JP-A-2016-128000 proposes a baseball game board having a shooting cover which is movable forward and rearward around a ball shooting hole. According to the baseball game board disclosed in JP-A-2016-128000, the operator moves the shooting cover forward and rearward. In this manner, the operator can select a pitching mode to allow the ball to move while floating in the air above the board surface and a pitching mode for moving the ball while the ball rolls on the board surface (on an upper surface plate).

SUMMARY

The baseball game board disclosed in Patent Document 1 is configured as follows. A trajectory or speed of the ball shot from the pitching unit is changed depending on a distance (movement amount) for the operator to pull a pitching operation lever toward a front side of the operator.

Therefore, for example, in a case where the operator wants to pitch the ball showing a trajectory in which the ball passes through a higher position in the vicinity of the front side of the batting unit, while the operator pulls the shooting cover toward the front side of the operator, the operator pulls the pitching operation lever until a rear end surface of the pitching operation lever contacts an inner wall surface on a rear side of a hole which accommodates the operation lever. In this manner, after the operator obtains a contact feeling, the operator can release the pitching operation lever.

However, in a case where the operator wants to pitch the ball showing the trajectory in which the ball passes through a position other than the high position (lower position or middle position) in the vicinity of the front side of the batting unit, the operator has to release the pitching operation lever by sensuously determining the distance (movement amount) for pulling the pitching operation lever to the front side of the operator.

In this way, an operation for adjusting the trajectory of the ball shot from the pitching unit requires balanced adjustment of the distance (the movement amount) from the operator, and the operator is unlikely to pitch the ball to an intended height of the operator. Therefore, it is not easy for a beginner to enjoy various pitching functions.

One or more embodiments of the present invention have been made in view of the above-described problem, and an object thereof is to provide a baseball game board which enables even a beginner to enjoy various pitching functions.

One or more embodiments of the present invention provide a baseball game board including: a main body unit simulating a baseball stadium and including an upper surface plate; a pitching unit configured to pitch a ball to allow the ball to move while floating in air; a batting unit configured to hit the ball; and a selection unit configured to gradationally select a ball height of the ball at a time of passing through the batting unit, wherein in accordance with a selection result of the selection unit, a trajectory of the ball shot from the pitching unit is changed.

According to one or more embodiments of the present invention, it is possible to provide a baseball game board which enables even a beginner to enjoy various pitching functions.

DETAILED DESCRIPTION

Hereinafter, a baseball game board according to an embodiment of the present invention will be described in detail with reference to the drawings.

Overall Configuration

Figure 1:
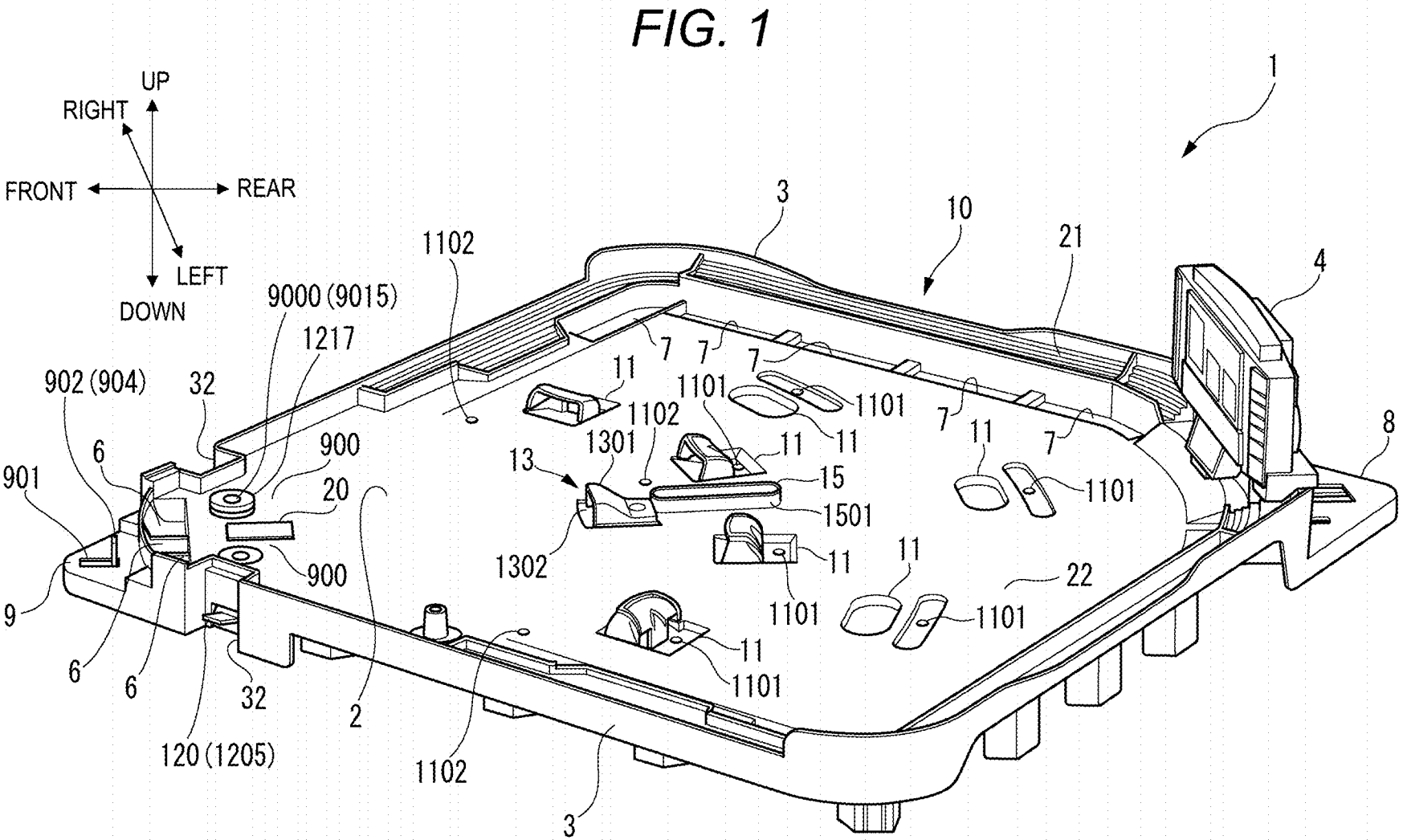
FIG. 1 is a top perspective view illustrating a baseball game board according to an embodiment of the present invention.

FIG. 1 is a top perspective view of a baseball game board 1 according to an embodiment of the present invention. As illustrated in FIG. 1, the baseball game board 1 according to the embodiment of the present invention has a baseball game board main body 10 simulating a baseball stadium. The baseball game board main body 10 has a playground part 22 in which a batting unit 900 and a pitching unit 13 are arranged, a stand part 21 disposed around the playground part 22, an upper surface plate 2 having a centerfield screen 4 located behind the pitching unit 13, and a main body peripheral wall part 3 disposed in an upward-downward direction from a periphery of the upper surface plate 2.

In addition, in describing the present embodiment, for convenience of description, a "rightward-leftward direction", a "forward-rearward direction", and an upward-downward direction" will be appropriately used. The directions are described using a direction of the batting unit 900 as a forward direction aligned with a pitcher's line of sight oriented in the direction of the batting unit 900 from the pitching unit 13. The upward-downward direction" includes an "upward direction" and a "downward direction". The "forward-rearward direction" includes the "forward direction" and a "rearward direction". The "rightward-leftward direction" includes a "rightward direction" and a "leftward direction".

The upper surface plate 2 has three recesses serving as a catching unit 6 formed in the forward direction of the batting unit 900. If a shot ball enters the recess at the center, a "strike" is counted. If the shot ball enters the recess on the right and left, a "ball" is counted.

In addition, the upper surface plate 2 also has a recess serving as a fielder catching unit 11 formed at a fielder positions of a first base, a second base, a third base, a shortstop base, a center fielder, a light fielder, and a left fielder in the playground part 22. If a batted ball enters the fielder catching unit 11, a "batter-out" is counted.

In addition, holes serving as a fielder standing portion 1101 for inserting and fixing miniature dolls simulating fielders are disposed in the rearward direction of each fielder catching unit 11.

Furthermore, the upper surface plate 2 has a plurality of recesses serving as a receiving port 7 formed along the stand part 21 in the playground part 22 immediately in front of a right field stand and a left field stand. The receiving port 7 located in a foul zone is used for a "foul ball", and the receiving ports 7 located in a fair zone are appropriately used for the "batter-out", a "single hit", a "double", and a "triple".

The upper surface plate 2 has holes respectively serving as runner standing portions 1102 into which the miniature dolls simulating runners can be inserted at respective base positions such as the first base, the second base, and the third base of the playground part 22.

In addition, in the upper surface plate 2, the batting units 900 are respectively disposed in the vicinity of right and left sides of a home plate in the playground part 22. The home plate (not illustrated) is drawn in the batting unit 900. A movable plate 20 is located in the rearward direction of the home plate. The movable plate 20 has a rectangular flat plate shape. The movable plate 20 is pivotable in the upward-downward direction.

Then, a rotary unit 9000 and an upper surface of a pedestal 1217 (to be described later) are exposed to the right and left of the movable plate 20 on an upper surface of the upper surface plate 2. A rod-shaped member simulating a bat (not illustrated) or a batter miniature doll having the rod-shaped member is inserted into an attachment portion 9015 disposed at the center of the rotary unit 9000. In this manner, the rod-shaped member simulating the bat can be rotated.

Further, the pitching unit 13 is located at a substantially central portion of the upper surface plate 2. In the pitching unit 13, a shooting hole 1302 for shooting the ball is located in the upper surface plate 2. In addition, the pitching unit 13 has a shooting cover 1301 for covering the shooting hole 1302 and a ball storage 15 located in the rearward direction of the shooting cover 1301.

The ball storage 15 has a peripheral wall part 1501 standing on the upper surface of the upper surface plate 2, and a plurality of balls can be surrounded by the peripheral wall part 1501. Furthermore, a bottom portion of the ball storage 15 is inclined. In this manner, the ball can fall downward of the upper surface plate 2 through a ball filling hole disposed inside the ball storage 15.

In the rearward direction of the centerfield screen 4, a pitching operation unit 8 having a height lower than a height of the upper surface plate 2 is formed outside the upper surface plate 2.

In the forward direction of the catching unit 6, a batting operation unit 9 having a height lower than the height of the upper surface plate 2 is formed outside the upper surface plate 2. The batting operation unit 9 has a batting knob 904 which is a portion of a batting operation lever 902.

The batting knob 904 is formed in a front end of the batting operation lever 902 of a batting mechanism (to be described later). The batting knob 904 protrudes from a batting operation hole 901 in the upward direction of the batting operation unit 9.

The batting operation hole 901 is a long hole extending in the forward-rearward direction so that the batting knob 904 is movable only in the forward-rearward direction.

In the main body peripheral wall part 3, a portion located in the rightward-leftward direction of the movable plate 20 has a recess 32 which is recessed toward the upper surface plate 2. The recess 32 has a hole formed at a position lower than the height of the upper surface plate 2. An adjustment lever 1205 which is a portion of an adjustment mechanism 120 (example of an adjustment unit) protrudes from the hole.

Ball Height Adjustment Mechanism

Figure 2:
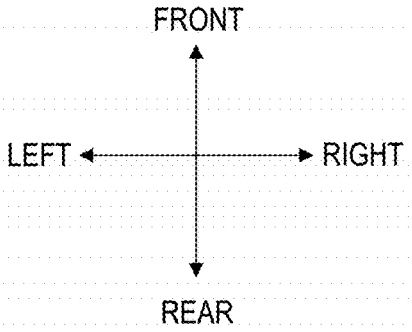
FIG. 2 is an enlarged view illustrating the vicinity of a pitching operation unit.
Figure 2:
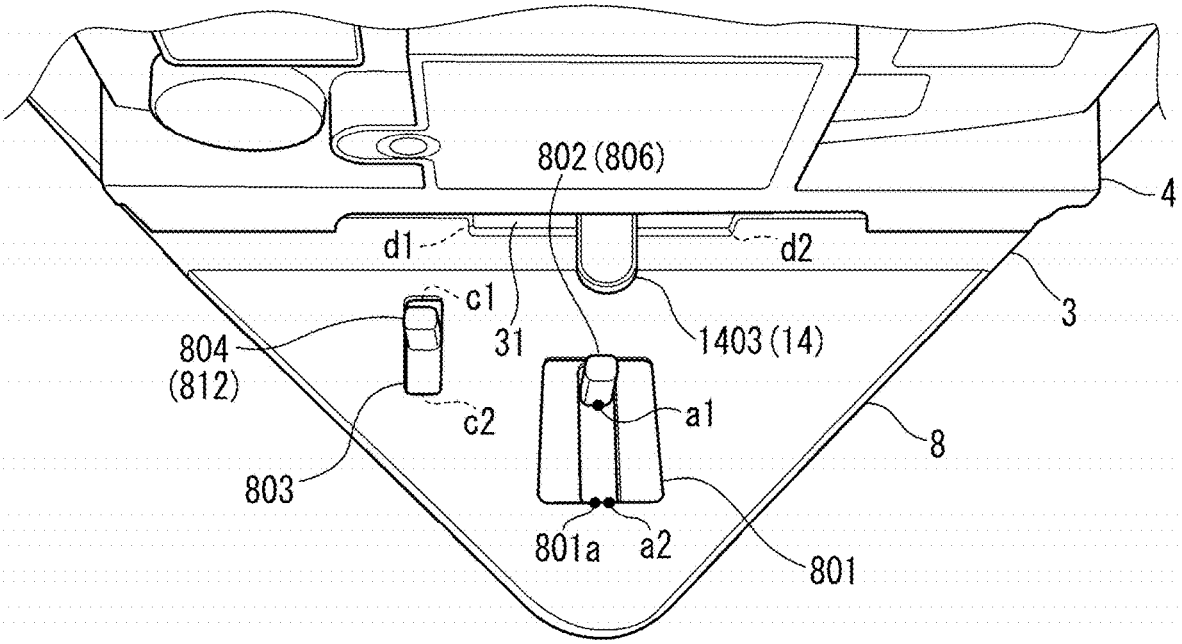

FIG. 2 is an enlarged view illustrating the vicinity of the pitching operation unit 8. As illustrated in FIG. 2, the pitching operation unit 8 has a pitching knob 802 of a pitching operation lever 806 (refer to FIG. 4) and a breaking ball knob 804 of a breaking ball operation lever 812 (refer to FIG. 4). The upper surface of the pitching operation unit 8 has a pitching operation hole 801 and a breaking ball operation hole 803. The pitching operation hole 801 is disposed at substantially the center of the pitching operation unit 8. The breaking ball operation hole 803 is disposed on the left side of the pitching operation unit 8 in the forward direction from the pitching operation hole 801.

Figure 4:
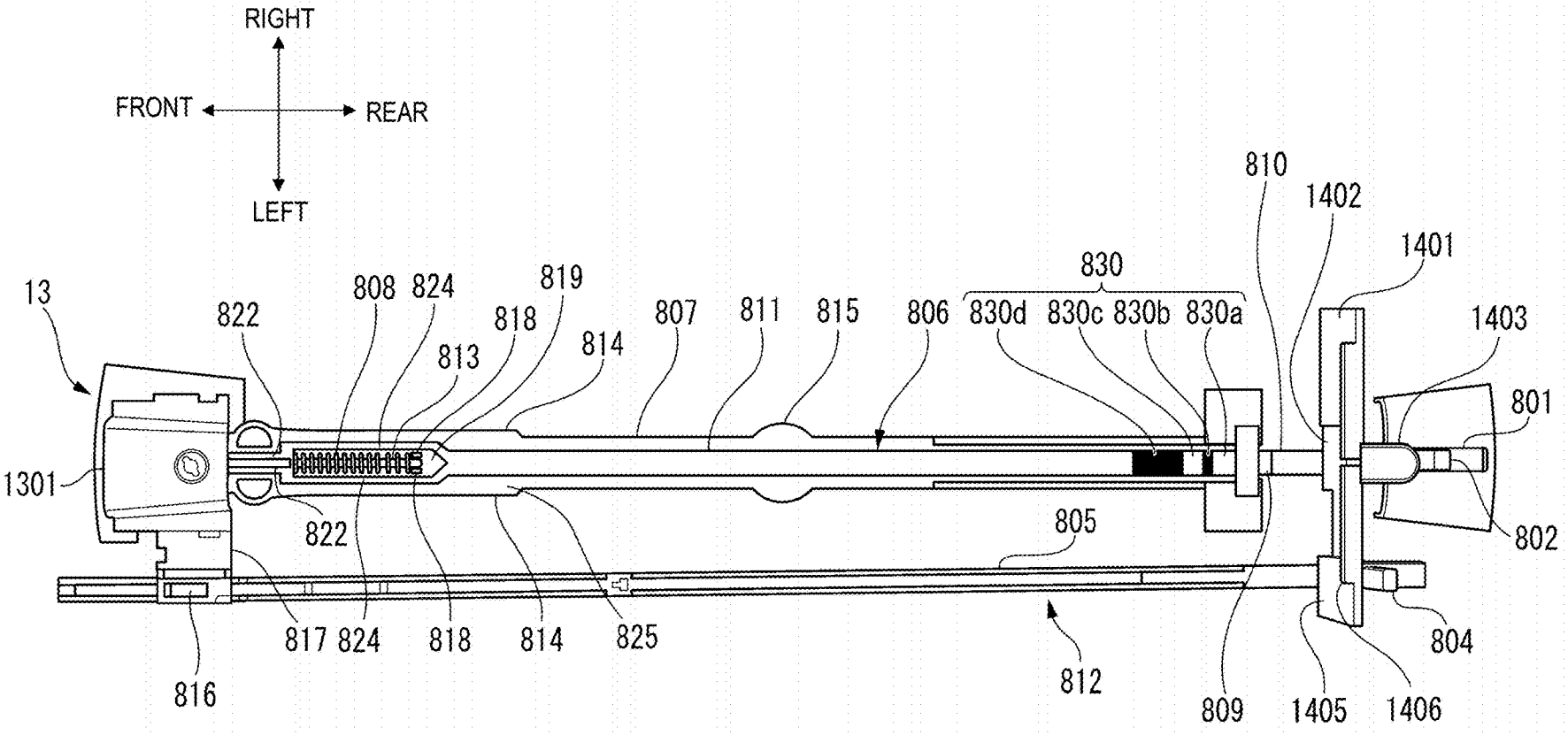
FIG. 4 is a plan view illustrating the vicinity of a pitching operation lever and a breaking ball stick according to the embodiment of the present invention.

The pitching knob 802 is formed in a rear end of a pitching stick 811 (refer to FIG. 4). The pitching knob 802 protrudes from the pitching operation hole 801 in the upward direction of the pitching operation unit 8. The breaking ball knob 804 is formed in a rear end of a breaking ball stick 805 (refer to FIG. 4). The breaking ball knob 804 protrudes from the breaking ball operation hole 803 in the upward direction of the pitching operation unit 8.

The breaking ball operation hole 803 is a long hole extending in the forward-rearward direction so that the breaking ball knob 804 is movable only in the forward-rearward direction. The pitching operation hole 801 is a long hole which is long in the forward-rearward direction of the pitching knob 802 and which is wide in the rightward-leftward direction of the pitching knob 802 so that the pitching knob 802 is movable in the forward-rearward direction and the rightward-leftward direction.

The pitching knob 802 is movable between a1 and a2 in the forward-rearward direction. In addition, the pitching knob 802 is also movable in the rightward-leftward direction. The breaking ball knob 804 is movable between c1 and c2 in the forward-rearward direction.

In the main body peripheral wall part 3, a movement hole 31 is formed on a surface located in the forward direction of the pitching operation unit 8. The movement hole 31 is a long hole extending in the rightward-leftward direction. A width of the movement hole 31 in the upward-downward direction is slightly larger than a thickness of an adjustment knob 1403 of a plate-shaped member 14 (refer to FIGS. 3A to 3C) which is an example of a selection unit. The adjustment knob 1403 protrudes rearward from the movement hole 31. A length of the movement hole 31 in the rightward-leftward direction is longer than a length of the adjustment knob 1403 in the rightward-leftward direction. According to the present embodiment, the length of the movement hole 31 in the rightward-leftward direction is approximately three times the length of the adjustment knob 1403 in the rightward-leftward direction. The adjustment knob 1403 is movable between d1 and d2 in the rightward-leftward direction.

Figure 3A:
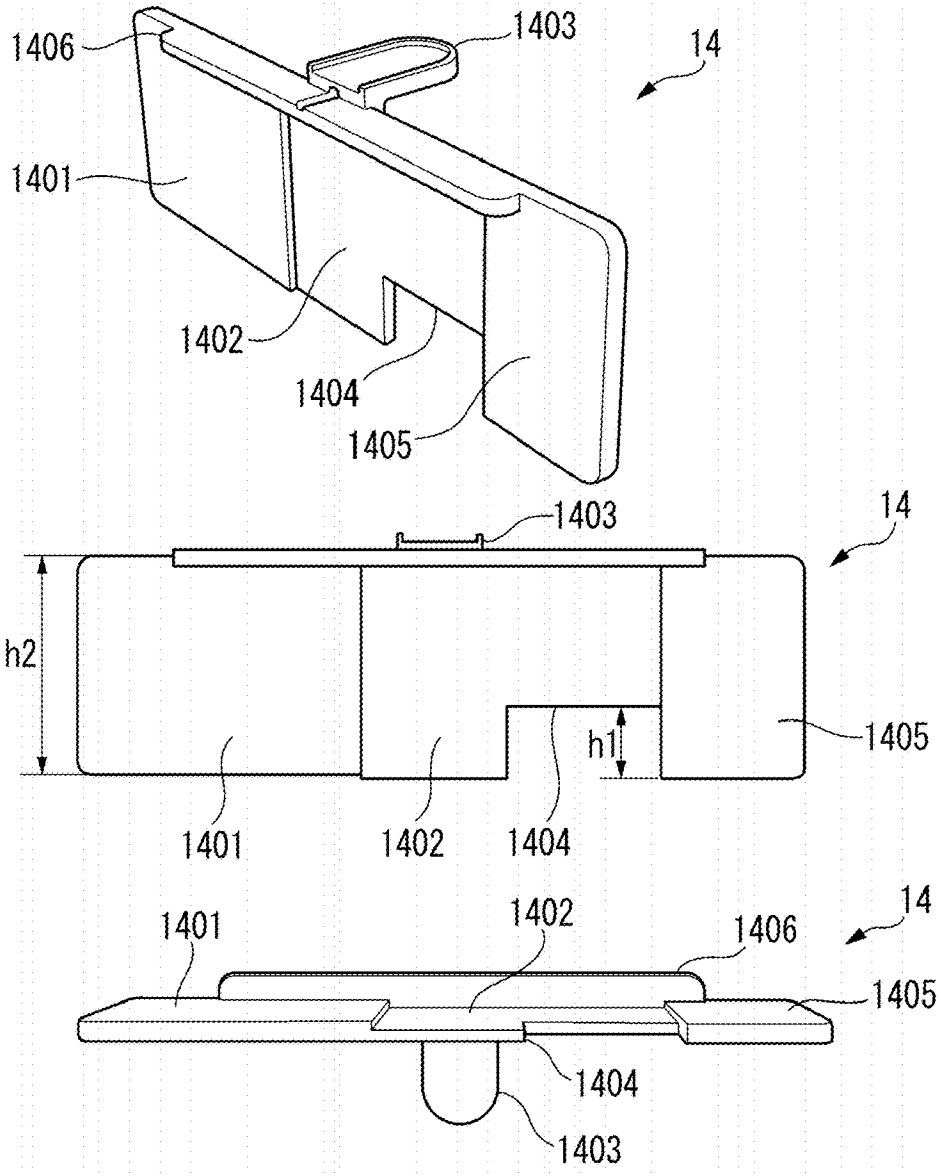
FIG. 3A is a perspective view of a plate-shaped member according to the embodiment of the present invention.
Figure 3A:
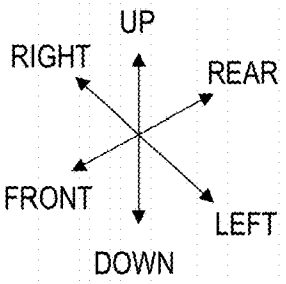
Figure 3B:
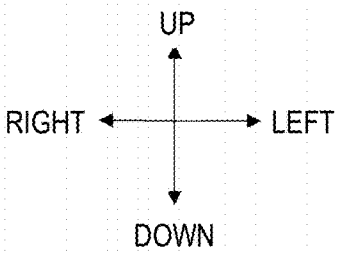
FIG. 3B is a view when the plate-shaped member according to the embodiment of the present invention is viewed in a forward direction.
Figure 3C:
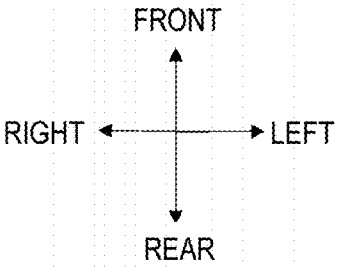
FIG. 3C is a view when the plate-shaped member according to the embodiment of the present invention is viewed in a downward direction.

FIG. 3A is a perspective view of the plate-shaped member 14 according to the embodiment of the present invention. FIG. 3B is a view when the plate-shaped member 14 according to one embodiment of the present invention is viewed in the forward direction. FIG. 3C is a view when the plate-shaped member 14 according to an embodiment of the present invention is viewed in the downward direction. As illustrated in FIGS. 3A to 3C, the plate-shaped member 14 is configured to include a first surface portion 1401, a second surface portion 1402, a third surface portion 1405, the adjustment knob 1403, and an edge portion 1406. A front end of the adjustment knob 1403 is connected to the edge portion 1406 in the vicinity of the center of the edge portion 1406 in the rightward-leftward direction. The edge portion 1406 extends in the forward direction. The edge portion 1406 is connected to the first surface portion 1401, the second surface portion 1402, and the third surface portion 1405.

As illustrated in FIG. 3B, the first surface portion 1401 is located on the right side of the plate-shaped member 14. The third surface portion 1405 is located on the left side of the plate-shaped member 14. The second surface portion 1402 is located between the first surface portion 1401 and the third surface portion 1405.

A cutout portion 1404 is formed below the second surface portion 1402. According to the present embodiment, the cutout portion 1404 is formed in a leftward-downward direction of the second surface portion 1402. A height h1 of the cutout portion 1404 in the upward-downward direction is shorter than a height h2 of the plate-shaped member 14 in the upward-downward direction.

As illustrated in FIG. 3C, the thickness of the first surface portion 1401 is substantially the same as the thickness of the third surface portion 1405. The thickness of the first surface portion 1401 is larger than the thickness of the second surface portion 1402. Each of a boundary between the first surface portion 1401 and the second surface portion 1402 and a boundary between the second surface portion 1402 and the third surface portion 1405 has a step in a thickness direction. The step has a right-angled stepped shape.

Figure 5:
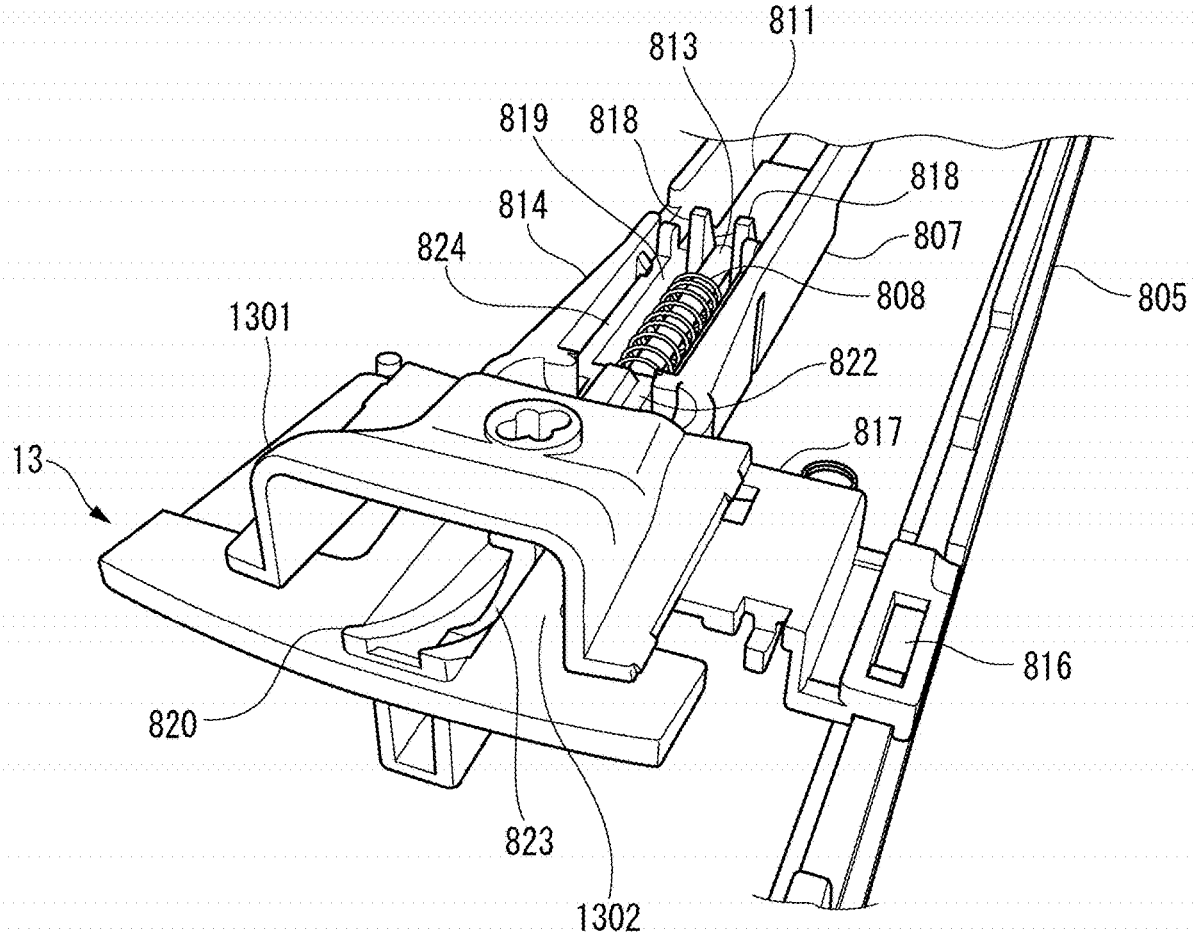
FIG. 5 is an enlarged perspective view illustrating the vicinity of a pitching unit according to the embodiment of the present invention.

FIG. 4 is a plan view illustrating the vicinity of the pitching operation lever 806 and the breaking ball operation lever 812 according to the embodiment of the present invention. FIG. 5 is an enlarged perspective view illustrating the vicinity of the pitching unit 13 according to the embodiment of the present invention.

As illustrated in FIGS. 4 and 5, the breaking ball operation lever 812 has a breaking ball knob 804 and a breaking ball stick 805 having an elongated rod shape. A front side portion of the breaking ball stick 805 has a projection portion 816. The projection portion 816 is located on the left side of the shooting cover 1301. The projection portion 816 is connected to the shooting cover 1301 via a coupling member 817.

The pitching operation lever 806 is configured to include a pulling portion 810 and a pitching stick 811 having an elongated rod shape.

The pitching stick 811 has a ball holder 823, a contact portion 809, a pitching main body portion 824, an elastic member storage 819, an elastic member holder 813, and a hole closing portion 822.

As illustrated in FIG. 5, the ball holder 823 is disposed in a front end of the pitching stick 811. The ball holder 823 has a U-shape, and can hold the ball.

As illustrated in FIG. 4, the contact portion 809 is disposed in a rear portion of the pitching stick 811. A front portion of the pulling portion 810 is coupled to the rear portion of the pitching stick 811. Therefore, the contact portion 809 also moves in accordance with a moving direction of the pulling portion 810. In addition, a rear end of the pulling portion 810 has the pitching knob 802.

The pitching main body portion 824 has a prismatic shape, and is disposed behind the ball holder 823.

The elastic member storage 819 is a portion serving as a groove hole penetrating a lower surface from an upper surface of the pitching main body portion 824. The elastic member storage 819 can accommodate an elastic member 808.

The elastic member holder 813 is disposed inside the elastic member storage 819. The rear end of the elastic member holder 813 is inserted between two elastic member receivers 818. The elastic member holder 813 has a rod shape, and can be inserted into the elastic member 808. The front end of the elastic member 808 is brought into contact with a front end wall of the elastic member storage 819, and the rear end of the elastic member 808 is brought into contact with the elastic member receiver 818 (to be described later). In this manner, the elastic member 808 is held in a slightly compressed state.

The hole closing portion 822 has a plate shape extending in the rightward-leftward direction, and is disposed between the ball holder 823 (refer to FIG. 5) and the pitching main body portion 824. The upper surface of the hole closing portion 822 has the height which is the same as the height of the upper surface of the pitching main body portion 824. The upper surface of the portion surrounded by the right and left hole closing portions 822 is slightly higher than the hole closing portion 822.

The pitching stick 811 is held by the pitching stick holder 807 having an elongated rod shape. As illustrated in FIGS. 4 and 5, the pitching stick holder 807 has a bottom surface portions 825, a side wall portion 814, an inclined portion 820, and two elastic member receivers 818 protruding from the bottom surface portion 825.

The inclined portion 820 is disposed in the vicinity of the front end of the pitching stick holder 807. The inclined portion 820 is gently curved, and has a shape ascending forward. A tip of the inclined portion 820 is located at the height close to the upper surface of the upper surface plate 2, and is located in the shooting hole 1302 of the upper surface plate 2.

The inclined portion 820 has a groove extending in the forward-rearward direction at the center along an axis of the pitching stick holder 807. A front end of the pitching stick 811 can be inserted into the groove.

In the baseball game board 1 according to the present embodiment, as an initial position, the front end of the pitching stick 811 is located on the front side of the pitching stick holder 807. When the pitching stick 811 is located at the initial position, the hole closing portion 822 closes a ball filling hole disposed inside the ball storage 15. The operator operates the pitching knob 802 with a finger, and moves the pitching operation lever 806 in the rearward direction. If the pitching operation lever 806 moves in the rearward direction, the ball holder 823 moves to below the ball filling hole. In this case, the ball falls down to the ball holder 823. In addition, the elastic member 808 is subjected to a force acting rearward of the elastic member storage 819 is applied to the elastic member 808, thereby bringing the elastic member into contact with the elastic member receiver 818. As a result, the elastic member 808 is compressed.

The fallen ball is held by the ball holder 823. If the operator releases his or her finger from the pitching knob 802, the elastic member 808 is released. Then, the pitching operation lever 806 is moved in the forward direction by using an elastic repulsive force of the compressed elastic member 808. If the pitching operation lever 806 is moved in the forward direction, the ball holder 823 is inserted into a groove of the inclined portion 820.

If the pitching operation lever 806 is moved in the forward direction, the ball held by the ball holder 823 ascends along the inclined portion 820, and is released so as to jump out of the shooting hole 1302 to the upper surface of the upper surface plate 2. When the shooting cover 1301 is located at the initial position, the released ball moves in a direction of the batting unit 900 while floating in the air.

The shooting cover 1301 is movable in the forward-rearward direction in accordance with the movement of the breaking ball operation lever 812 in the forward-rearward direction. If the operator pushes the breaking ball knob 804 forward, the breaking ball operation lever 812 moves in the forward direction, and the shooting cover 1301 moves in the forward direction via the coupling member 817. In this state, if the ball is released so as to jump out of the shooting hole 1302 to the upper surface of the upper surface plate 2, the ball comes into contact with an inner surface of the shooting cover 1301. In this manner, while rolling on the upper surface plate 2, the ball moves toward batting unit 900.

In addition, as illustrated in FIG. 4, a circular flange portion 815 is disposed at substantially the center of the pitching stick holder 807. An insertion hole is disposed in a central portion of the flange portion 815. A pivot shaft disposed in a pitching operation cover (not illustrated) located on a bottom surface of the baseball game board main body 10 is inserted into the insertion hole. If the operator moves the pitching knob 802 in the rightward-leftward direction, the pitching stick holder 807 pivots to the right and left respectively in a range of approximately 5°. Therefore, the operator can shoot the ball not only toward the center of the home plate drawn in the batting unit 900, but also toward a position slightly away from the center of the home plate in the rightward-leftward direction.

Further, a magnet 19 (refer to FIG. 7) is placed on a rear surface of the upper surface plate 2 at a substantially intermediate position between the pitching unit 13 and the batting unit 900. The ball shot toward the center of the home plate moves straight forward since the ball passes immediately above the magnet 19. On the other hand, the ball shot in a direction slightly shifted to the right and left passes through the vicinity of an outer periphery of the magnet 19. Accordingly, a forward moving course is bent due to an attractive force of the magnet 19.

In a case where shooting speed of the ball is slow, the ball is greatly affected by the magnet 19. In a case where the shooting speed of the ball is fast, the ball is less affected by the magnet 19. Therefore, if a shooting direction of the ball is changed, it is possible to pitch a straight ball to the center of a strike course. Moreover, it is possible to pitch a fast ball close to the straight ball to an outside course or an inside course. Alternatively, a ball simulating a breaking ball such as a butterfly ball can be pitched to the outside course or the inside course.

Furthermore the front end of the breaking ball stick 805 has a pressing portion 821 (refer to FIG. 7) (to be described later). The pressing portion 821 is connected to the movable plate 20. Therefore, if the operator pulls the breaking ball knob 804 rearward, the breaking ball stick 805 moves rearward, and the front end of the movable plate 20 descends. Therefore, the ball can be fallen down to the upper surface plate 2 within a bat swing range. In this manner, the other player can fail to bat the pitched ball when he or she swings the bat.

Furthermore, a first code 830*a*, a second code 830*b*, a third code 830*c*, and a fourth code 830*d* are attached to a rear upper surface of the pitching operation lever 806. In the following description, in some case, the first code 830*a*, the second code 830*b*, the third code 830*c*, and the fourth code 830*d* may be collectively referred to as a code 830. The code 830 is located in the order of the first code 830*a*, the second code 830*b*, the third code 830*c*, and the fourth code 830*d* when viewed from the operator of the pitching operation lever 806.

Figure 6:
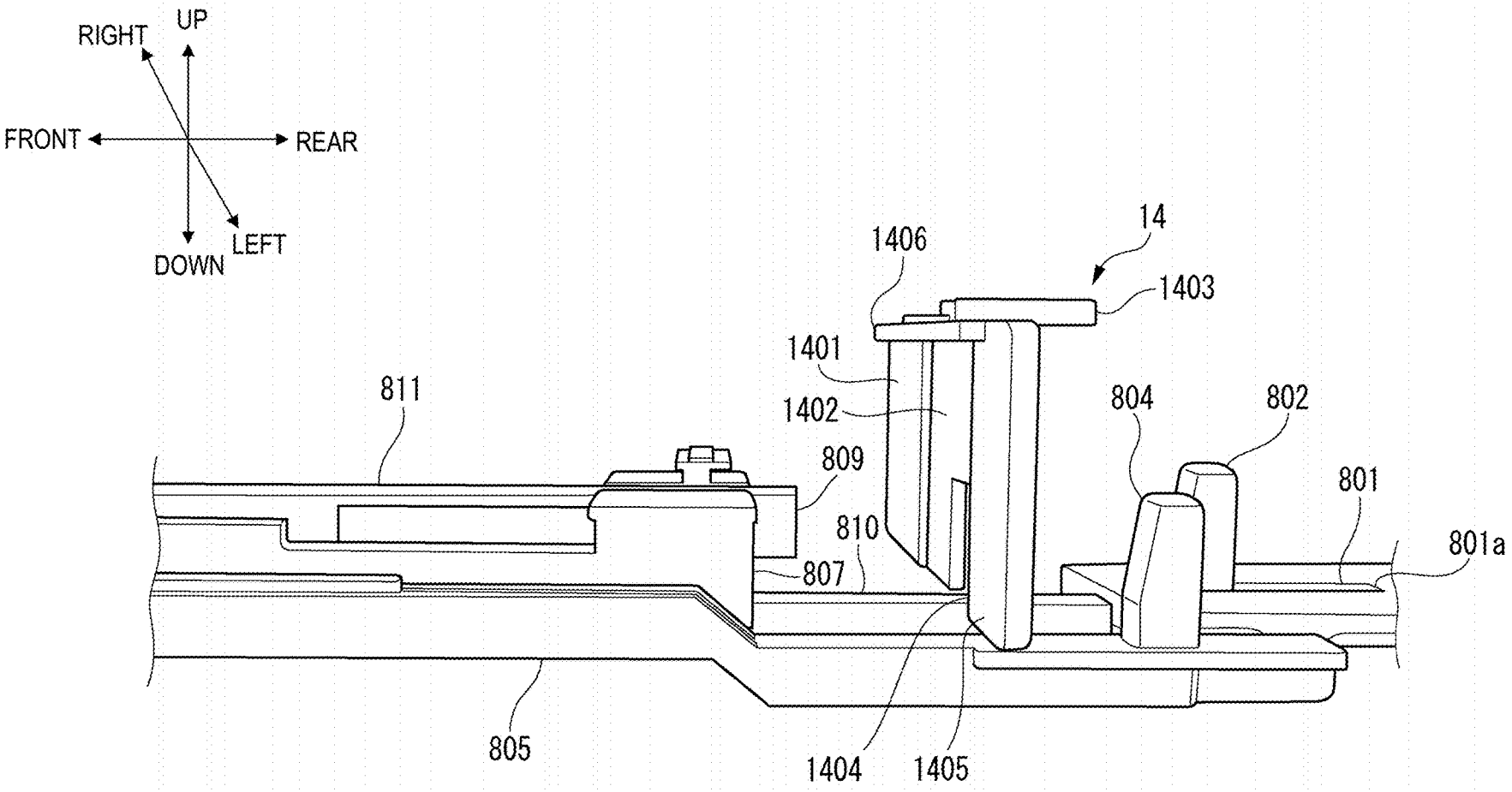
FIG. 6 is a view when the plate-shaped member according to the embodiment of the present invention is viewed from a side surface.

Referring to FIG. 6, a state will be described where the operator adjusts a height of the ball shot from the shooting hole 1302. FIG. 6 is a view when the vicinity of the plate-shaped member 14 according to the embodiment of the present invention is viewed from a side surface. As illustrated in FIG. 6, the plate-shaped member 14 is located between the contact portion 809 and the pitching knob 802.

The pitching knob 802 is movable in the forward-rearward direction and the rightward-leftward direction. Therefore, for example, if the operator pulls the pitching knob 802 in the rearward direction, the pulling portion 810 having the pitching knob 802 moves in the rearward direction. Along with this movement, the pitching stick 811 held by the pulling portion 810 also moves in the rearward direction. Accordingly, if the operator pulls the pitching knob 802 in the rearward direction, the contact portion 809 disposed in the rear end of the pitching stick 811 moves in the rearward direction. If the operator pulls the pitching knob 802 up to a predetermined distance in the rearward direction, the contact portion 809 comes into contact with the first surface portion 1401 or the second surface portion 1402 belonging to the plate-shaped member 14, or passes through the cutout portion 1404.

The adjustment knob 1403 is movable in the rightward-leftward direction. Therefore, the operator can locate the plate-shaped member 14 at a predetermined position by moving the adjustment knob 1403 to the right and left. That is, the operator can adjust a position of the plate-shaped member 14 by moving the adjustment knob 1403 to the right and left. As a result, the operator can gradationally select the ball height at the time of passing through the batting unit 900. According to the present embodiment, there are three patterns such as a case where the contact portion 809 passes through the cutout portion 1404 (Pattern 1), a case where the contact portion 809 comes into contact with the first surface portion 1401 (Pattern 2), and a case where the contact portion 809 comes into contact with the second surface portion 1402 (Pattern 3). Therefore, the operator can select the ball height from the three patterns such as a high ball, a middle ball, and a low ball.

In a case where the operator wants to increase the ball height (Pattern 1), the operator moves the adjustment knob 1403 in the rightward direction. Thereafter, the operator pulls the pitching knob 802 in the rearward direction. Then, the cutout portion 1404 is located at a position facing the contact portion 809. As a result, the contact portion 809 of the pitching operation lever 806 does not come into contact with the plate-shaped member 14. Therefore, the pitching knob 802 can be pulled to a position where the contact portion 809 comes into contact with an inner wall surface 801*a* on the rear side of the pitching operation hole 801. A movement amount of the pitching operation lever 806 is maximized. Accordingly, a compression amount of the elastic member 808 is also maximized. As a result, the ball is shot from the shooting hole 1302 with the strongest elastic force. Therefore, when the ball passes through the vicinity of the batting unit 900, the ball is located at the highest position.

In a case where the operator wants to decrease the ball height (Pattern 2), the operator moves the adjustment knob 1403 in the leftward direction. Thereafter, the operator pulls the pitching knob 802 in the rearward direction. Then, the first surface portion 1401 is located at a position facing the contact portion 809. As a result, the contact portion 809 of the pitching operation lever 806 comes into contact with the first surface portion 1401 located in the forward direction from the inner wall surface of the baseball game board main body 10. Therefore, the operator cannot pull the pitching knob 802 up to a position where the pitching knob 802 comes into contact with the inner wall surface 801*a* on the rear side of the pitching operation hole 801. In this case, the movement amount of the pitching operation lever 806 is minimized. Accordingly, the compression amount of the elastic member 808 is also minimized. As a result, the ball is shot from the shooting hole 1302 with the weakest elastic force. Therefore when the ball passes through the vicinity of the batting unit 900, the ball is located at the lowest position.

In a case where the operator wants the ball height to be located in the middle (Pattern 3), the operator moves the adjustment knob 1403 to substantially the center of the movement hole 31. Thereafter, the operator pulls the pitching knob 802 in the rearward direction. Then, the second surface portion 1402 is located at a position facing the contact portion 809. As a result, the contact portion 809 of the pitching operation lever 806 comes into contact with the second surface portion 1402 located in the forward direction from the inner wall surface of the baseball game board main body 10. Therefore, the operator cannot pull the pitching knob 802 up to a position where the pitching knob 802 comes into contact with the inner wall surface 801*a* on the rear side of the pitching operation hole 801. In this case, the movement amount of the pitching operation lever 806 in the rearward direction is larger than that in Pattern 2, but is smaller than that in Pattern 1. Therefore, the compression amount of the elastic member 808 is larger than that in Pattern 2, but is smaller than that in Pattern 1. As a result, when the ball passes through the vicinity of the batting unit 900, the ball height is higher than that in Pattern 2, but is lower (in the middle) than that in Pattern 1.

The fallen position of the ball in Pattern 3 is in the vicinity of the center of the home plate. Therefore, the fallen position of the ball in Pattern 1 is a position closer to the forward direction from the center of the home plate. The fallen position of the balls in Pattern 2 is a position closer to the rearward direction from the center of the home plate.

According to this configuration, when the operator pitches the ball so as to move while the ball floats in the air, the operator operates the plate-shaped member 14 in advance which is an example of the selection unit. In this manner, the operator can select the ball height of the ball at the time of passing through the batting unit 900. In accordance with a selection result of the plate-shaped member 14 (selection unit), a trajectory of the ball shot from the pitching unit is changed. The operation of the plate-shaped member 14 (selection unit) can be gradationally selected from among the high ball, the middle ball, and the low ball, for example. The operation does not require balanced adjustment of the operator. Therefore, the operation for determining the ball height can be more satisfactorily reproduced. In this way, according to this configuration, even a beginner can easily enjoy various pitching functions.

In addition, according to this configuration, the plate-shaped member 14 (selection unit) is operated, thereby enabling the operator to adjust the maximum movement amount of the pitching operation lever 806 to be pulled. Therefore, after the plate-shaped member 14 (selection unit) is operated, the operator pulls the pitching operation lever 806 up to a position where the pitching operation lever 806 can be pulled, and releases the pitching operation lever 806. In this manner, the pitching unit can easily pitch the ball by using the height selected by the plate-shaped member 14 (selection unit).

In addition, according to this configuration, a difference between the thickness of the first surface portion 1401 and the thickness of the second surface portion 1402 of the plate-shaped member 14 (selection unit) is utilized. In this manner, the operator can adjust the maximum movement amount which enables the operator to pull the pitching operation lever 806.

In addition, according to this configuration, the operator performs the operation for locating the plate-shaped member 14 (selection unit) so that the contact portion 809 of the pitching operation lever 806 passes through the cutout portion 1404. In this manner, the operator can maximize the movement amount which enables the operator to pull the pitching operation lever 806.

Bat Height Adjustment Mechanism

Figure 7:
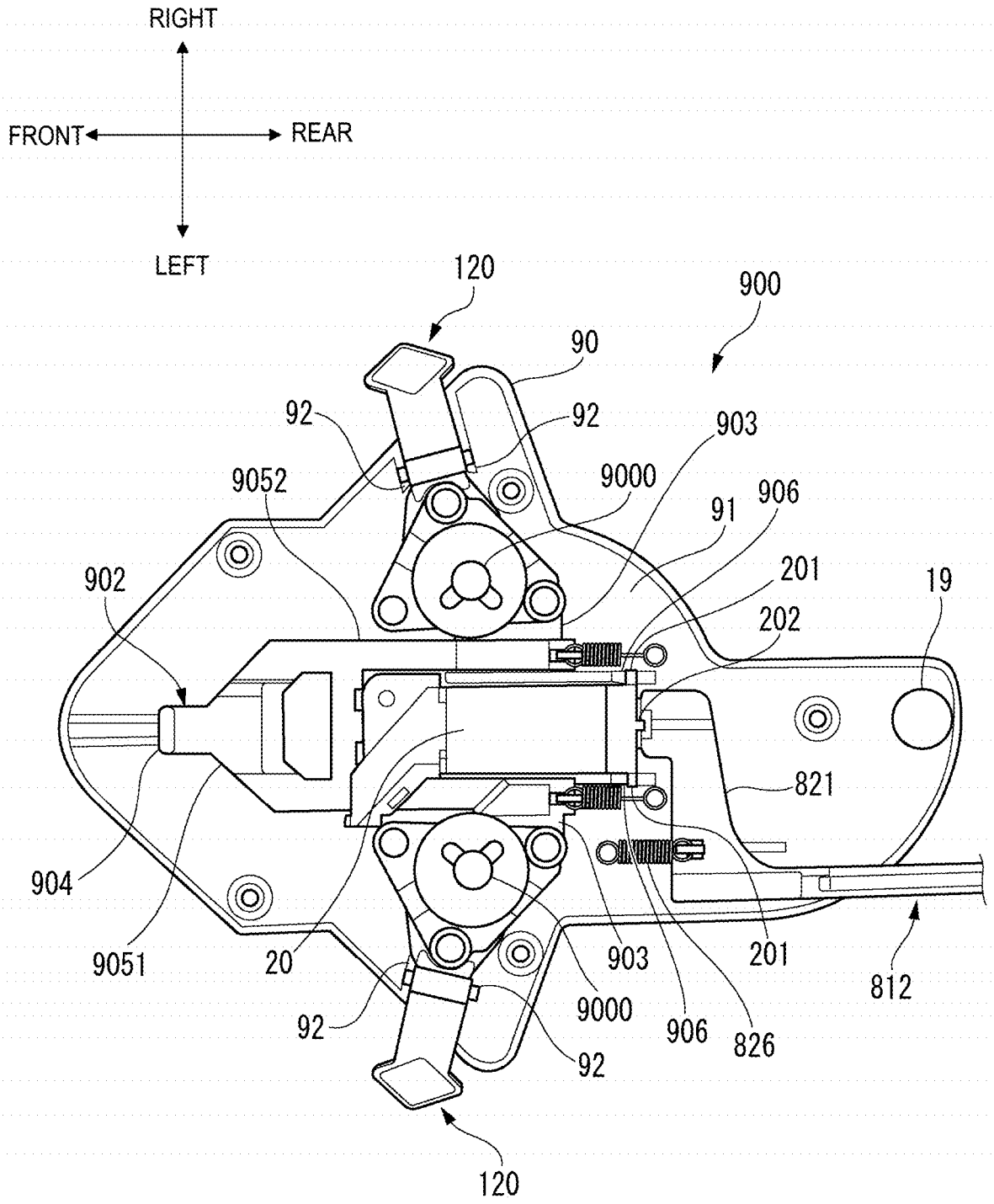
FIG. 7 is a plan view illustrating a batting mechanism according to the embodiment of the present invention.
Figure 8:
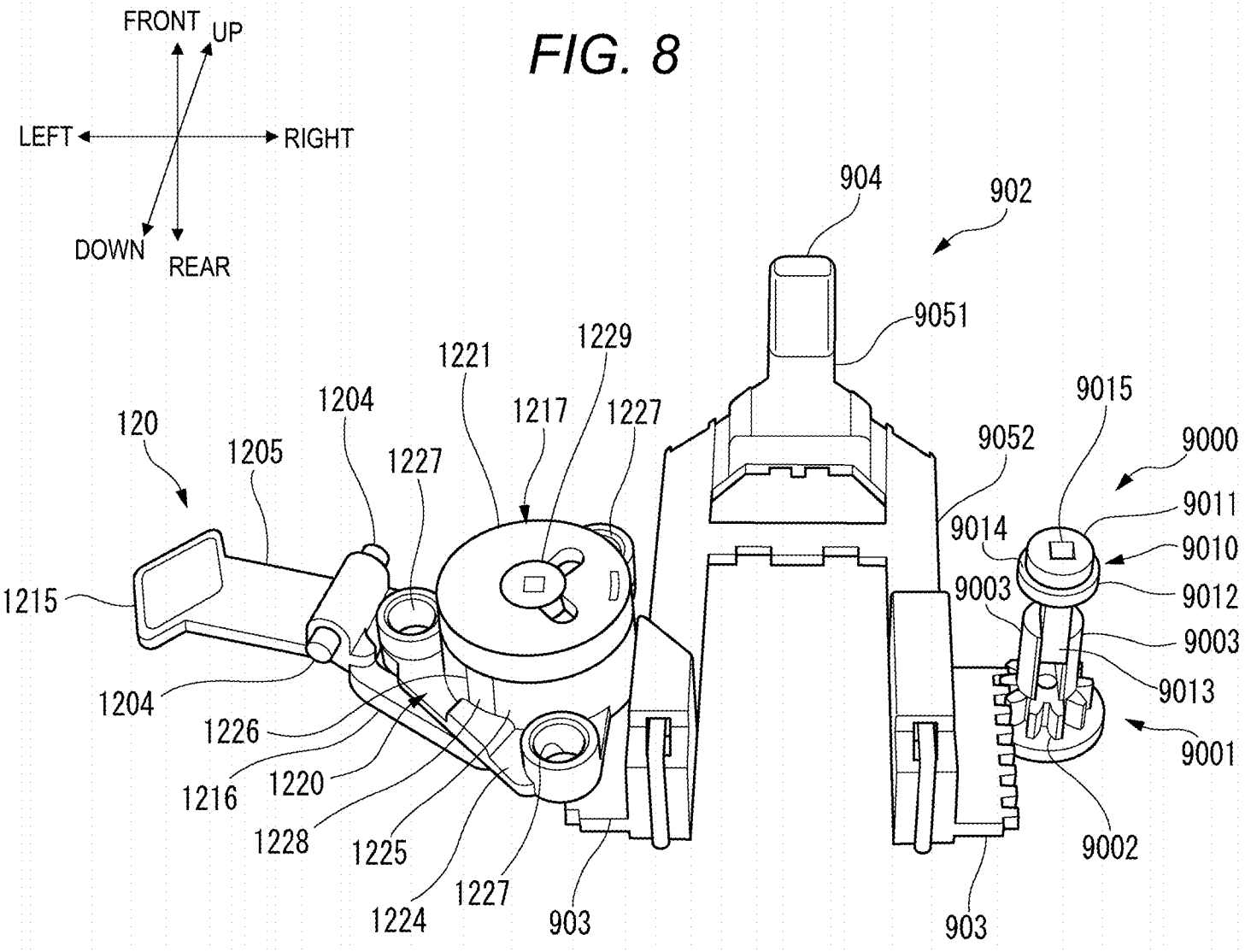
FIG. 8 is a top perspective view illustrating the batting mechanism according to the embodiment of the present invention.

FIG. 7 is a plan view illustrating the batting mechanism according to the embodiment of the present invention. FIG. 8 is a top perspective view illustrating the batting mechanism according to the embodiment of the present invention. As illustrated in FIG. 7, the batting mechanism of the batting unit 900 is configured to include a batting operation lever 902 and a rotary unit 9000. The batting mechanism is located below the upper surface plate 2 via the lower portion of the batting unit 900 from below the batting operation unit 9. The batting mechanism is accommodated in a cover 90 disposed so as to cover the rear surface of the upper surface plate 2 from the batting operation unit 9 to the vicinity of the magnet 19.

As illustrated in FIG. 8, the batting operation lever 902 has a base main body portion 9051 extending in the forward-rearward direction, and a batting knob 904 erected upward from the front end of the base main body portion 9051. The rear end of the base main body portion 9051 has two rod-shaped parallel main body portions 9052 arranged parallel to each other with a gap on the right and left in the further rearward direction. The outer surface of the parallel main body portion 9052 has a rack portion 903. A side surface of the rack portion 903 has a saw tooth-shaped fold.

The rotary unit 9000 is configured to include a first rotary shaft member 9001 and a second rotary shaft member 9010. The first rotary shaft member 9001 has a pinion portion 9002 and a cylindrical support member 9003. The pinion portion 9002 has a plurality of gear-shaped folds. The pinion portion 9002 meshes with the rack portion 903 of the batting operation lever 902. Therefore, if the batting operation lever 902 moves in the forward-rearward direction, the pinion portion 9002 is rotated in conjunction with the movement of the batting operation lever 902. The support member 9003 has a semi-cylindrical shape. The support member 9003 has a groove. A slide portion 9013 (to be described later) can be inserted into the groove.

The second rotary shaft member 9010 is configured to include a first circular portion 9011, a second circular portion 9012, and a plate-shaped slide portion 9013 suspended downward from the second circular portion 9012. The center of the upper surface of the first circular portion 9011 and the second circular portion 9012 has a rectangular hole. In addition, the center of the upper surface of the slide portion 9013 also has a hole formed in the downward direction. The hole formed in the slide portion 9013 extends to a substantially intermediate portion of the slide portion 9013. The two holes are continuous with each other, and function as an attachment portion 9015. The diameter of the first circular portion 9011 is smaller than the diameter of the second circular portion 9012. Therefore, the second circular portion 9012 has a peripheral edge portion 9014. In addition, the diameter of the cylindrical support member 9003 and the front-rear width of the slide portion 9013 are smaller than the diameter of the second circular portion 9012. The slide portion 9013 can move the groove formed in the support member 9003 in the upward-downward direction. In addition, the slide portion 9013 is supported by the support member 9003 since there is a slight gap between the slide portion 9013 and the right and left grooves of the support member 9003. Therefore, if the first rotary shaft member 9001 is rotated, the second rotary shaft member 9010 is rotated in the same direction as the rotation direction of the first rotary shaft member 9001.

As illustrated in FIG. 7, the batting mechanism, the movable plate 20, the pressing portion 821 of the breaking ball operation lever 812, and the adjustment mechanism 120 are arranged on the bottom plate 91 of the cover 90.

The movable plate 20 is located between the two rack portions 903. The rear end of the movable plate 20 has a shaft portion 201 extending in the rightward-leftward direction and a suspended portion 202 suspended downward from the rear end. The plate support portions 906 are respectively disposed between the rack portion 903 and the movable plate 20. The shaft portion 201 is supported by the plate support portion 906. In addition, the front end of the breaking ball operation lever 812 has a pressing portion 821. The pressing portion 821 is in contact with the suspended portion 202. The pressing portion 821 is biased forward by a plate holding spring 826. The pressing portion 821 is brought into contact with the rear surface of the suspended portion 202 in the movable plate 20. In this manner, the lower portion of the suspended portion 202 is pressed forward.

The movable plate 20 normally forms a plane which is the same as the upper surface of the upper surface plate 2. However, if the breaking ball operation lever 812 moves rearward, the pressing portion 821 also moves rearward. Therefore, the front end of the movable plate 20 pivots so as to descend.

The adjustment mechanisms 120 are arranged one by one on the right and left side surfaces of the respective parallel main body portions 9052.

As illustrated in FIG. 8, the adjustment mechanism 120 is configured to include an adjustment lever 1205 and a pedestal 1217. The left end of the adjustment lever 1205 has a finger contact portion 1215 having a substantially diamond shape. Substantially the center of the adjustment lever 1205 has a shaft rod 1204 extending in the forward-rearward direction. The shaft rod 1204 is supported by a bearing portion 92 (refer to FIG. 7) disposed in the bottom plate 91. The right end of the adjustment lever 1205 has a pressing-up portion 1216.

The pedestal 1217 is configured to include a receiving member 1220 and a cap member 1221. The receiving member 1220 is configured to include a substantially triangular base plate 1224 and a cylinder member 1225 formed at the center of the receiving member 1220. A circular hole 1227 is formed in each apex of the base plate 1224. The center of the cylinder member 1225 has a circular hole into which the support member 9003 and the slide portion 9013 can be inserted. The diameter of the hole is smaller than the diameter of the second circular portion 9012. Therefore, if the slide portion 9013 (second rotary shaft member 9010) is inserted into the hole from above, the lower surface of the peripheral edge portion 9014 comes into contact with the upper surface of the receiving member 1220. The side surface of the cylinder member 1225 has a slit portion 1226.

The cap member 1221 has a circular shape. The cap member 1221 has a retaining member 1228 which can be inserted into the slit portion 1226. The retaining member 1228 is inserted into the slit portion 1226, thereby fixing the cap member 1221 to the receiving member 1220. The center of the cap member 1221 has a circular insertion hole 1229. The diameter of the insertion hole 1229 is larger than the diameter of the first circular portion 9011, and is smaller than the diameter of the second circular portion 9012.

Therefore, if the rotary unit 9000 is covered by the pedestal 1217, the cap member 1221 is supported by the peripheral edge portion 9014.

The thickness of the circular portion of the cap member 1221 is substantially the same as the thickness of the first circular portion 9011. Therefore, even in a state where the rotary unit 9000 is covered by the pedestal 1217, the upper surface portion of the pedestal 1217 is flat.

Figure 9A:
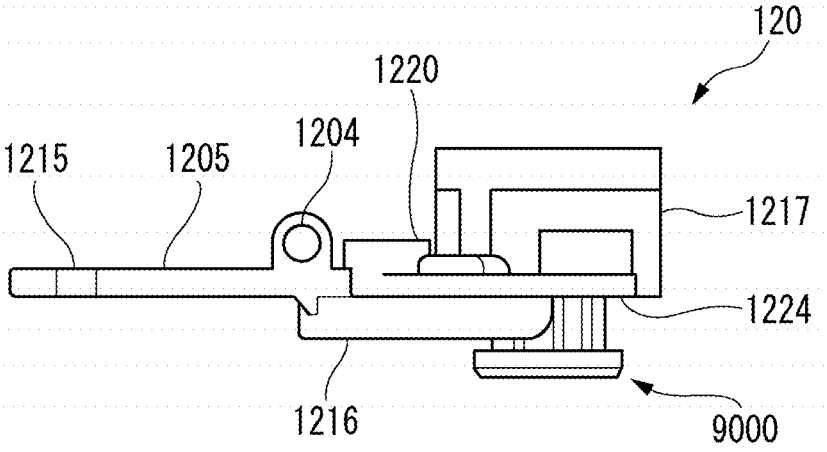
FIG. 9A is a view when an adjustment mechanism in a normal state according to the embodiment of the present invention is viewed in a rearward direction.
Figure 9B:
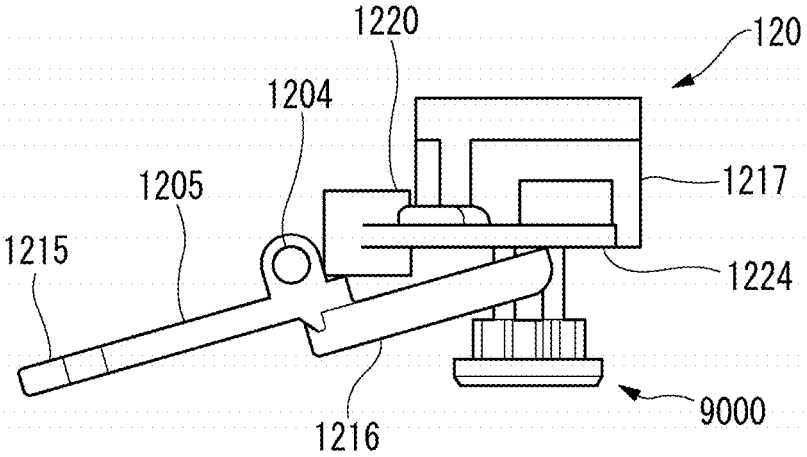
FIG. 9B is a view when the adjustment mechanism in an ascending state according to the embodiment of the present invention is viewed in the rearward direction.
Figure 9C:
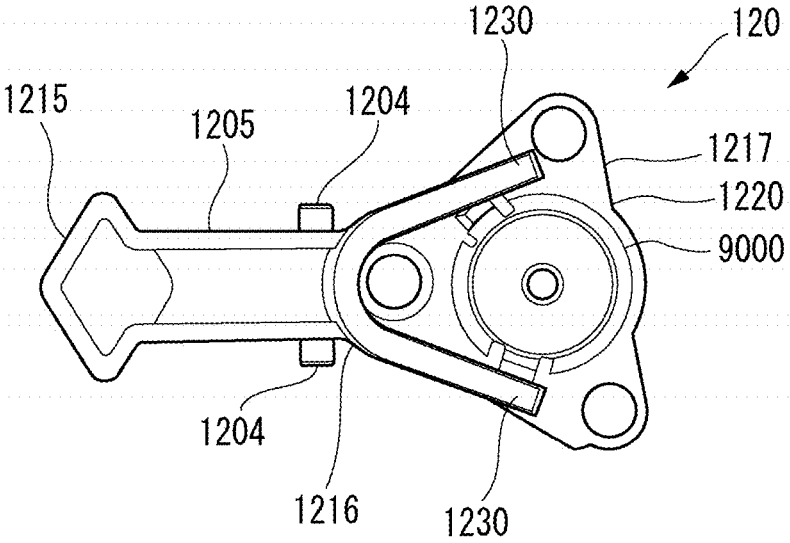
FIG. 9C is a view when the adjustment mechanism according to the embodiment of the present invention is viewed in the downward direction.

FIG. 9A is a view when the adjustment mechanism 120 in a normal state according to the embodiment of the present invention is viewed in the rearward direction. FIG. 9B is a view when the adjustment mechanism 120 in an ascending state according to the embodiment of the present invention is viewed in the rearward direction. FIG. 9C is a view when the adjustment mechanism 120 according to the embodiment of the present invention is viewed in the downward direction. As illustrated in FIG. 9A, the adjustment lever 1205 is normally in a horizontal state. In this case, the upper surface of the pressing-up portion 1216 faces the base plate 1224. In addition, in this case, the position of the upper surface of the rotary unit 9000 is located at the same position as that of the upper surface plate 2.

If the operator presses down the finger contact portion 1215 with his or her finger, as illustrated in FIG. 9B, the finger contact portion 1215 moves in the downward direction. In contrast, the pressing-up portion 1216 ascend in the upward direction since the shaft rod 1204 serves as a fulcrum. If the pressing-up portion 1216 ascends, the pedestal 1217 is pressed up in the upward direction by the pressing-up portion 1216. If the pedestal 1217 ascends, the lower surface of the peripheral edge portion 9014 (refer to FIG. 8) is pressed up to the upper surface of the receiving member 1220, and the second rotary shaft member 9010 inserted into the pedestal 1217 also ascends.

In this manner, the upper surface of the rotary unit 9000 protrudes to a position which is higher than that of the upper surface plate 2. Accordingly, the rod-shaped member simulating the bat attached to the attachment portion 9015 or the rod-shaped member simulating the bat belonging to the batter miniature doll ascends, and the bat position becomes higher than usual.

Then, if the operator releases his or her finger from the finger contact portion 1215, the pedestal 1217 and the second rotary shaft member 9010 move in the downward direction.

As illustrated in FIG. 9C, the pressing-up portion 1216 is bifurcated, and has a U-shape. Therefore, if the pressing-up portion 1216 ascends, the pedestal 1217 is lifted by a bifurcated end portion 1230 of the pressing-up portion 1216. As a result, a force applied to the pressing-up portion 1216 when the pedestal 1217 is lifted is dispersed.

According to this configuration, when the operator on the batting side predicts or determines that the ball flies higher, the operator operates the adjustment lever 1205 so as to adjust the height of the rod-shaped member, and can perform the operation for rotating the rod-shaped member. In this manner, the operator on the batting side enables the rod-shaped member to bat the ball which flies higher. Therefore, both the operator on the pitching side and the operator on the batting side can fully enjoy a game using various pitching functions.

In addition, the operator can operate the batting operation lever 902 while adjusting the height of the attachment portion 9015 in the rotary unit 9000. Therefore, the operator can smoothly perform a series of operations including the operation for adjusting the height of the rod-shaped member and the operation for rotating the rod-shaped member by operating each lever.

In addition, according to this configuration, the first rotary shaft member 9001 interlocked with the operation of the batting operation lever 902 and the second rotary shaft member 9010 interlocking with the operation of the adjustment lever are configured to respectively include separate components. Therefore, a rack-and-pinion mechanism for converting linear motion into rotational motion and a mechanism for adjusting the height for rotating the rod-shaped member are less likely to interfere with each other. Therefore, the respective mechanisms are easily and smoothly operated.

Pitching Result Display Mechanism

Figure 10A:
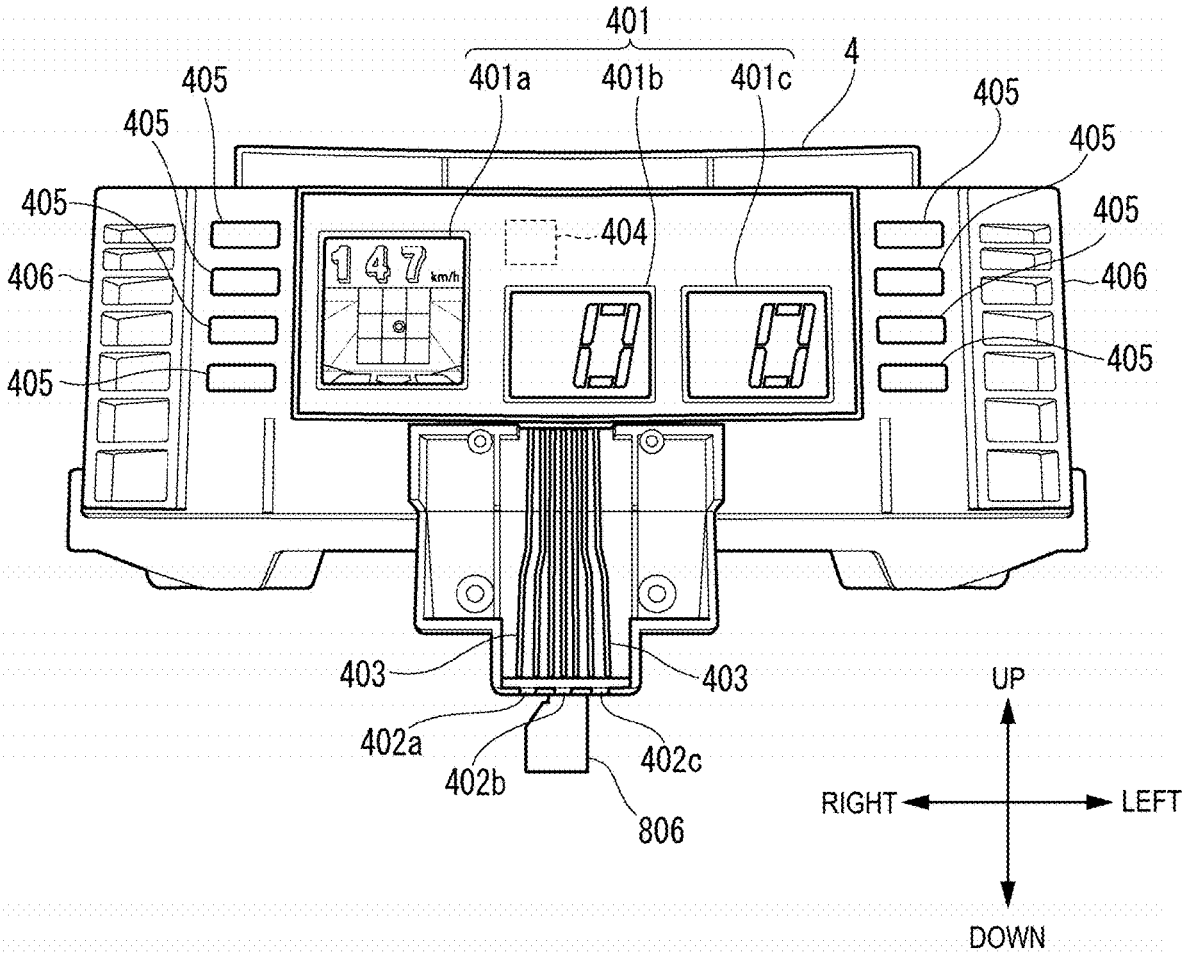
FIG. 10A is a view when a centerfield screen according to the embodiment of the present invention is viewed in the forward direction.
Figure 10B:
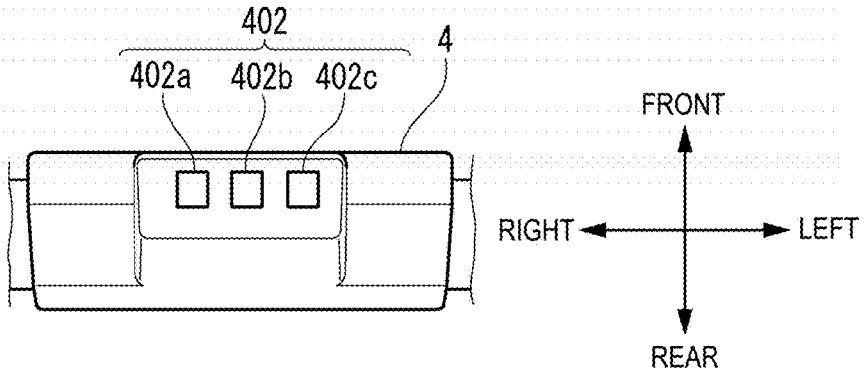
FIG. 10B is a partially enlarged view illustrating a lower portion of the centerfield screen.

FIG. 10A is a view when the centerfield screen 4 (example of a display unit) according to an embodiment of the present invention is viewed in the forward direction. FIG. 10B is a partially enlarged view illustrating a lower portion of the centerfield screen 4. As illustrated in FIG. 10A, the centerfield screen 4 includes a first display screen 401*a*, a second display screen 401*b*, a third display screen 401*c*, a first sensor 402*a*, a second sensor 402*b*, a third sensor 402*c*, a signal line 403, a determination unit 404, an operation button 405, and a speaker 406. In the following description, in some cases, the first display screen 401*a*, the second display screen 401*b*, and the third display screen 401*c* may be collectively referred to as a display screen 401. In addition, in some cases, the first sensor 402*a*, the second sensor 402*b*, and the third sensor 402*c* may be collectively referred to as a sensor 402.

The first display screen 401*a* is a display such as a liquid crystal display and an organic EL display. The first display screen 401*a* displays a screen corresponding to each mode. For example, a pitching course of the ball pitched by the operator and a ball speed can be displayed on the screen. For example, the modes include a baseball game mode and a strikeout mode. For example, the pitching course described herein indicates a ball passing position in the vicinity of the home plate. According to the present embodiment, the course (pitching course) in which the operator pitches the ball has a total of 15 square blocks including three vertical rows and five horizontal columns. The three vertical rows indicate the ball height. The ball height indicates three types such as the high ball, the middle ball, and the low ball. The five horizontal columns indicates the course of the ball in the rightward-leftward direction. Out of the 15 square blocks, a total of nine square blocks having the three vertical rows and the three columns at the center in the horizontal direction indicate a strike zone, and the other square blocks indicate a ball zone. The first display screen 401*a* displays a pitching course frame so as to surround the strike zone.

The second display screen 401*b* and the third display screen 401*c* are displays such as the liquid crystal display and the organic EL display. The second display screen 401*b* and the third display screen 401*c* display numbers corresponding to the respective play modes. In a case of a baseball game mode, for example, the score of each player is displayed on the second display screen 401*b* and the third display screen 401*c*. In a case of a strikeout mode, for example, the number of balls entering the strike zone is displayed on the second display screen 401*b*, and the number of remaining balls to be pitched is displayed on the third display screen 401*c*. In this example, one number is displayed using seven segment light emitting elements. For example, as the light emitting element, for example, a light emitting diode (LED) light emitting element or a laser light emitting element can be adopted.

As illustrated in FIG. 10B, the lower portion of the centerfield screen 4 has the sensors 402. The sensors 402 are arranged side by side in the rightward-leftward direction. The interval between the first sensor 402*a* and the second sensor 402*b* is approximately one-third of the width of the pitching operation lever 806. The interval between the second sensor 402*b* and the third sensor 402*c* is equal to the interval between the first sensor 402*a* and the second sensor 402*b*. The sensor 402 is configured to detect a code 830 (refer to FIG. 4) attached to the pitching operation lever 806. If a first code 830*a* or a third code 830*c* is detected, the sensor 402 transmits a signal A (ON-signal) to the determination unit 404. The sensor 402 continuously transmits a signal B (OFF-signal) to the determination unit 404 while the sensor 402 detects neither the first code 830*a* nor the third code 830*c*.

Referring back to FIG. 10A, description will be continued. For example, the signal line 403 is a copper wire. The signal line 403 is a route of an electric signal transmitted to the determination unit 404 by the sensor 402.

The determination unit 404 includes one or more central processing units (CPU) and one or more memories. The CPU and the memory are installed inside the centerfield screen 4. The CPU is a calculation device in which a main memory and a flash memory which are connected to each other in a data readable and writable manner are used as a main calculation storage region. The determination unit 404 processes the signal received from the sensor 402 on a binary basis. The determination unit 404 processes the signal A as 0, and processes the signal B as 1. The determination unit 404 calculates the ball speed, based on the signal received from the sensor 402. Specific processing contents will be described later.

In addition, the determination unit 404 determines the ball height, based on the calculated ball speed as will be described later. Furthermore, the determination unit 404 determines the course of the ball in the rightward-leftward direction. The determination unit 404 combines the ball height and the course in the rightward-leftward direction with each other so as to determine the pitching course. The determination unit 404 also serves as a control device for controlling the first display screen 401*a* to display the pitching course and the ball speed. The pitching course and the ball speed are displayed on the first display screen 401*a*. A program for performing the calculation process on the pitching course and the ball speed is stored in advance in an incorporated storage unit such as the flash memory, for example.

In addition, in a case where the play mode is the strikeout mode, the determination unit 404 determines whether the pitched ball enters the strike zone, based on the identified pitching course. If the determination unit 404 determines that the pitched ball enters the strike zone, the determination unit 404 controls the second display screen 401*b* to increment the number by one. Furthermore, the determination unit 404 controls the third display screen 401*c* to decrement the number by one, each time the balls are pitched one by one.

A plurality of operation buttons 405 are disposed on the front surface of the centerfield screen 4. According to the present embodiment, every four of the operation buttons 405 are disposed on the right side of the first display screen 401*a* and on the left side of the third display screen 401*c*. The operation buttons 405 include a button for switching display contents of the display screen 401 and a button for causing the speaker 406 to emit sound. For example, if the operation button 405 for switching the display contents of the display screen 401 is pressed down by the operator, an electric signal associated with the operation button 405 which is pressed down is transmitted to the determination unit 404. The determination unit 404 controls the display of the first display screen 401*a*, based on the electric signal.

The speakers 406 are respectively disposed on the right and left side surfaces of the centerfield screen 4. For example, the speaker 406 emits words or sound effects such as "batter-out", "safe", "home run", "ball", and "strike".

Figure 11A:
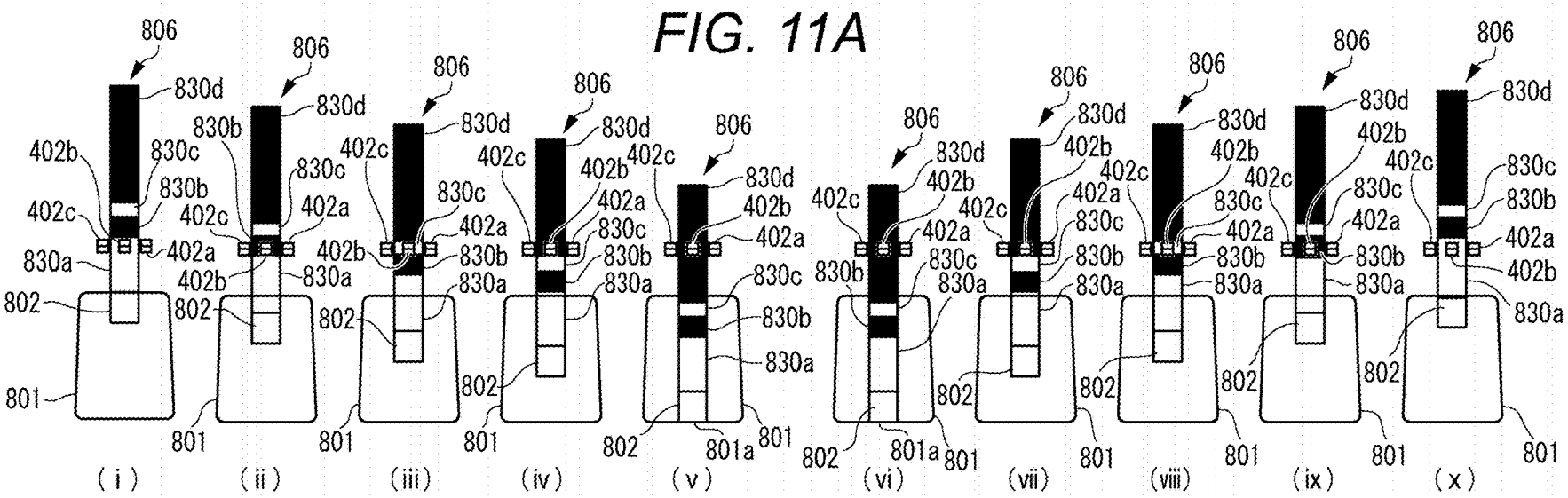
FIG. 11A is a view illustrating movement transition of the pitching operation lever.
Figure 11B:
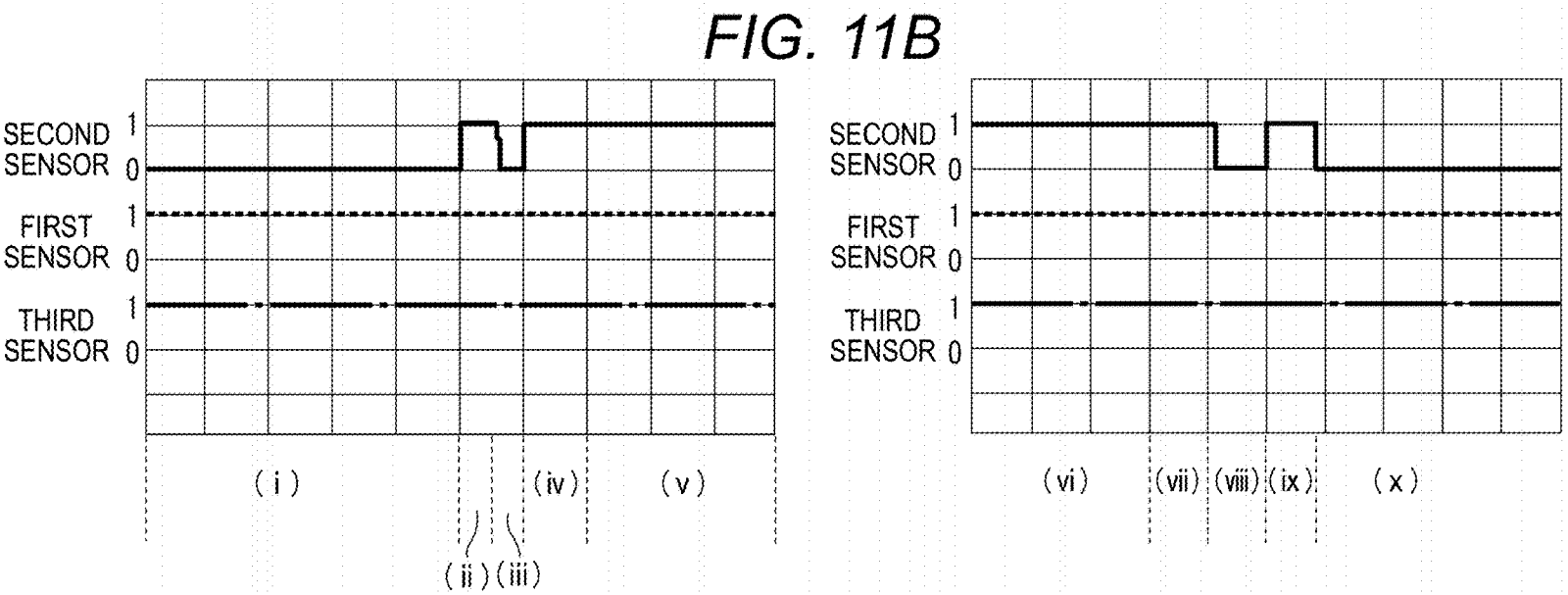
FIG. 11B is a view illustrating a state of signal processing in a determination unit.

Referring to FIGS. 11A and 11B, signal processing performed by the determination unit 404 will be described. FIG. 11A is a view illustrating movement transition of the pitching operation lever 806. FIG. 11B is a view illustrating a state of the signal processing in the determination unit 404.

As illustrated by (i) in FIG. 11A, when the pitching operation lever 806 is located at a normal position, the first code 830*a* is located below the second sensor 402*b*. In this case, the determination unit 404 receives the signal A from the second sensor 402*b*. As illustrated by (i) in FIG. 11B, the determination unit 404 processes the signal A received from the second sensor 402*b*, as 0 during a period of (i).

If the operator starts to pull the pitching operation lever 806 rearward, the second code 830*b* passes below the second sensor 402*b* as illustrated by (ii) in FIG. 11A. In this case, the determination unit 404 receives the signal B from the second sensor 402*b*. As illustrated by (ii) in FIG. 11B, the determination unit 404 processes the signal B received from the second sensor 402*b*, as 1 during the period.

Furthermore, if the operator pulls the pitching operation lever 806 rearward, the third code 830*c* passes below the second sensor 402*b* as illustrated by (iii) in FIG. 11A. In this case, the determination unit 404 receives the signal A from the second sensor 402*b*. As illustrated by (iii) in FIG. 11B, the determination unit 404 processes the signal A received from the second sensor 402*b*, as 0 during the period.

As illustrated by (iv) and (v) in FIG. 11A, if the operator further pulls the pitching knob 802 rearward until the rear end of the pitching operation lever 806 comes into contact with the inner wall surface 801*a* of the pitching operation hole 801, the fourth code 830*d* passes below the second sensor 402*b*. In this case, the determination unit 404 receives the signal B from the second sensor 402*b*. As illustrated by (iv) and (v) in FIG. 11B, the determination unit 404 processes the signal B received from the second sensor 402*b*, as 1 during the period.

As illustrated by (vi) in FIG. 11A, when the rear end of the pitching operation lever 806 is in contact with the inner wall surface 801*a*, the fourth code 830*d* is located below the second sensor 402*b*. In this case, the determination unit 404 receives the signal B from the second sensor 402*b*. As illustrated by (vi) in FIG. 11B, the determination unit 404 processes the signal B received from the second sensor 402*b*, as 1 during the period.

Thereafter, if the operator releases the pitching knob 802, the pitching operation lever 806 starts to move forward. If the pitching operation lever 806 starts to move forward, as illustrated by (vii) and (viii) in FIG. 11A, during this period, after the fourth code 830*d* passes below the second sensor 402*b*, the third code 830*c* passes below the second sensor 402*b*. Therefore, as illustrated by (vii) in FIG. 11B, while the fourth code 830*d* passes below the second sensor 402*b*, the determination unit 404 processes the signal B received from the second sensor 402*b*, as 1. On the other hand, while the third code 830*c* passes below the second sensor 402*b*, as illustrated by (viii) in FIG. 11B, the determination unit 404 processes the signal A received from the second sensor 402*b*, as 0.

If the pitching operation lever 806 moves further forward, the second code 830*b* passes below the second sensor 402*b* as illustrated by (ix) in FIG. 11A. Thereafter, as illustrated by (x) in FIG. 11A, the first code 830*a* passes below the second sensor 402*b*. Therefore, as illustrated by (ix) in FIG. 11B, while the second code 830*b* passes below the second sensor 402*b*, the determination unit 404 processes the signal B received from the second sensor 402*b*, as 1. On the other hand, as illustrated by (x) in FIG. 11B, while the first code 830*a* passes below the second sensor 402*b*, the determination unit 404 processes the signal A received from the second sensor 402*b*, as 0.

In the example illustrated in FIGS. 11A and 11B, the pitching operation lever 806 does not pass below the first sensor 402*a* and the third sensor 402*c*. Therefore, the determination unit 404 continuously receives the signal B from the first sensor 402*a* and the third sensor 402*c*. As illustrated in FIG. 11B, the determination unit 404 continuously processes the signals received from the first sensor 402*a* and the third sensor 402*c*, as 1.

Figure 12A:
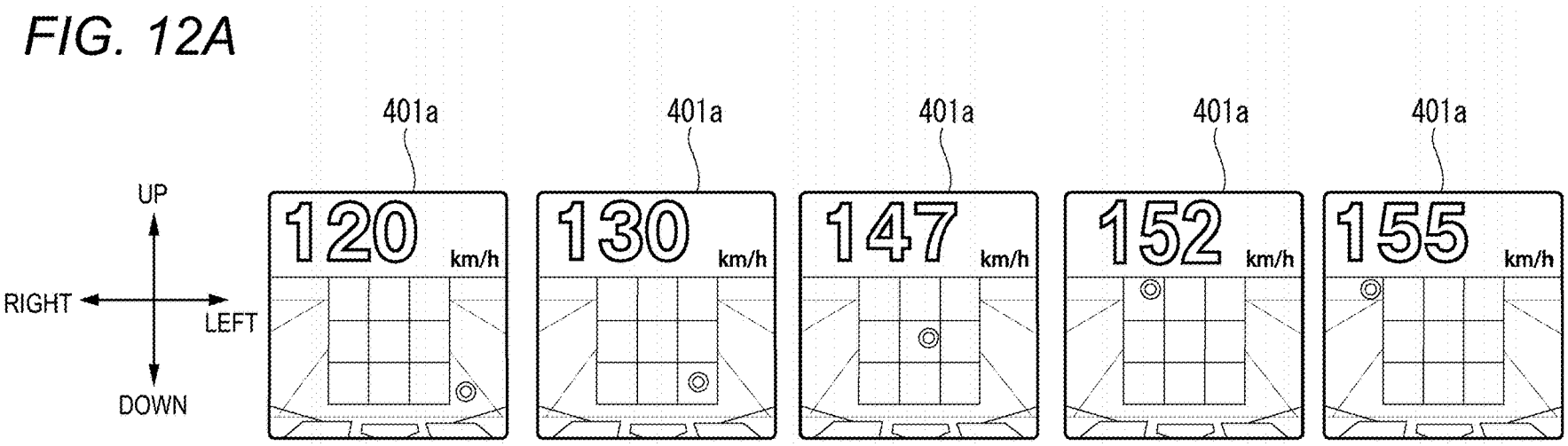
FIG. 12A is a view illustrating a display of a first display screen of the centerfield screen.
Figure 12B:
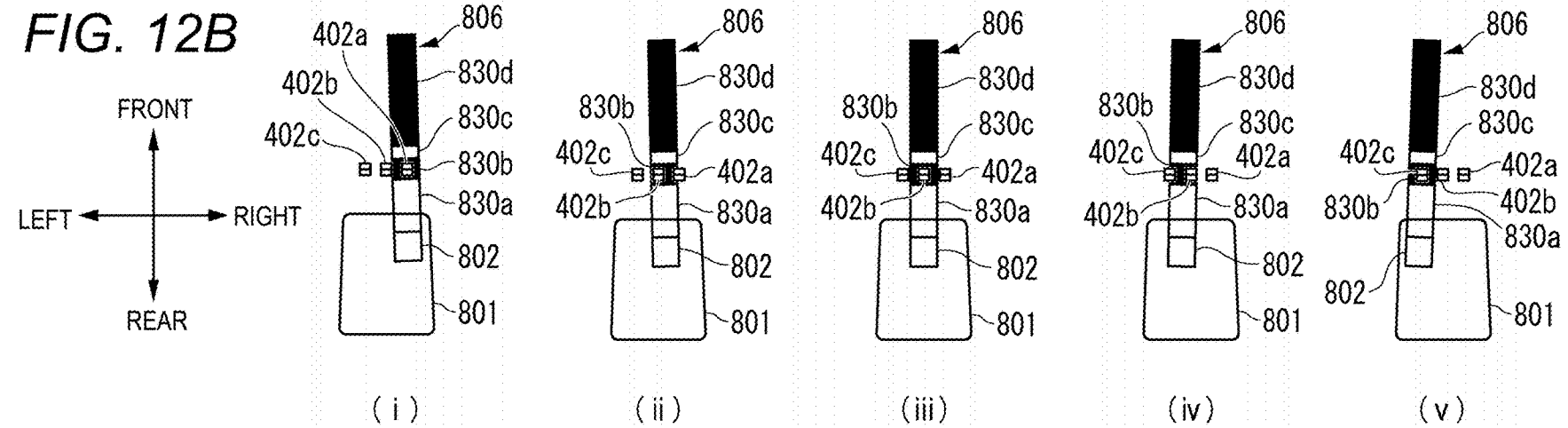
FIG. 12B is a view illustrating a positional relationship between a sensor and a second code.

Referring to FIGS. 12A and 12B, a display pattern of the first display screen 401*a* in the baseball game mode and a passing position of the pitching operation lever 806 in each display pattern will be described. FIG. 12A is a view illustrating a display of the first display screen 401*a* of the centerfield screen 4. FIG. 12B is a view illustrating a positional relationship between the sensor 402 and the second code 830*b*.

The operator moves the adjustment knob 1403 until the adjustment knob 1403 comes into contact with the left end of the movement hole 31, and pulls the pitching knob 802 rearward so as to come into contact with the right side surface of the pitching operation hole 801. In a case where the pitching knob 802 is released, the pitching operation lever 806 passes below the first sensor 402*a* as illustrated by (i) in FIG. 12B. The first sensor 402*a* transmits the electric signals to the determination unit 404 in the order of the signal B, the signal A, the signal B, and the signal A. On the other hand, the second sensor 402*b* and the third sensor 402*c* continuously transmit the signal B to the determination unit 404. In this case, the determination unit 404 determines that the pitching operation lever 806 passes below the first sensor 402*a*. In this case, the pitching stick holder 807 holding the pitching stick 811 pivots approximately 5° in the leftward direction. Accordingly, the determination unit 404 determines that the ball is pitched to a left side ball zone in the horizontal direction.

In addition, in this case, the contact portion 809 of the pitching operation lever 806 comes into contact with the first surface portion 1401 located in the forward direction from the inner wall surface of the baseball game board main body 10 (Pattern 2). Therefore, the movement amount of the pitching operation lever 806 is minimized, and the compression amount of the elastic member 808 is also minimized. As a result, the moving speed of the pitching operation lever 806 is slower than the moving speed of the pitching operation lever 806 in Pattern 1 or Pattern 3 described above. Accordingly, a time required for the third code 830*c* to pass below the first sensor 402*a* is maximized. The determination unit 404 calculates the speed of the ball from a transmission time of the signal A transmitted based on the third code 830*c*, and classifies the calculated ball speed. According to the present embodiment, the ball speed is classified into three categories. The three categories are high speed, medium speed, and low speed. In a case where the determination unit 404 classifies the calculated ball speed as the high speed, any one value from 152 km/h to 161 km/h is randomly displayed on the first display screen 401*a* as the ball speed. In a case where the determination unit 404 classifies the calculated ball speed as the medium speed, any one value from 135 km/h to 151 km/h is randomly displayed on the first display screen 401*a* as the ball speed. In a case where the determination unit 404 classifies the calculated ball speed as the slow speed, any one value from 65 km/h to 134 km/h is randomly displayed on the first display screen 401*a* as the ball speed. The classification of the ball speed described herein is merely an example, and other classification methods may be applied. In this example, the determination unit 404 classifies the ball speed as the slow speed. In this example, the determination unit 404 controls the first display screen 401*a* to display 120 km/h. In addition, as described above, the ball height in the vicinity of the home plate is proportional to the movement amount of the pitching operation lever 806. Therefore, the determination unit 404 determines that the ball height is low if the ball speed is classified as the slow speed. As a result, the first display screen 401*a* displays a screen illustrated by (i) in FIG. 12A.

The operator moves the adjustment knob 1403 until the adjustment knob 1403 comes into contact with the left end of the movement hole 31, and moves the pitching knob 802 to a substantially intermediate position between the center and the right side surface of the pitching operation hole 801. Thereafter, in a case where the pitching knob 802 is released, the pitching operation lever 806 passes below the first sensor 402*a* and the second sensor 402*b* as illustrated by (ii) in FIG. 12B. The first sensor 402*a* and the second sensor 402*b* transmits the electric signals to the determination unit 404 in the order of the signal B, the signal A, the signal B, and the signal A. On the other hand, the third sensor 402*c* continuously transmits the signal B to the determination unit 404. In this case, the determination unit 404 determines that the pitching operation lever 806 passes below the first sensor 402*a* and the second sensor 402*b*. In this case, the pitching stick holder 807 pivots approximately 2° in the leftward direction. Accordingly, the determination unit 404 determines that the ball is pitched to the left side ball zone in the horizontal direction.

In addition, in this case, the contact portion 809 of the pitching operation lever 806 comes into contact with the first surface portion 1401 located in the forward direction from the inner wall surface of the baseball game board main body 10 (Pattern 2). Therefore, the determination unit 404 classifies the ball speed as the slow speed. According to the present embodiment, the determination unit 404 controls the first display screen 401*a* to display 130 km/h. In addition, the determination unit 404 determines that the ball height is low. As a result, the first display screen 401*a* displays a screen illustrated by (ii) in FIG. 12A.

The operator moves the adjustment knob 1403 to substantially the center of the movement hole 31, and moves the pitching knob 802 to substantially the center of the pitching operation hole 801. Thereafter, in a case where the pitching knob 802 is released, the pitching operation lever 806 passes below the second sensor 402*b* as illustrated by (iii) in FIG. 12B. The second sensor 402*b* transmits the electric signals to the determination unit 404 in the order of the signal B, the signal A, the signal B, and the signal A. On the other hand, the first sensor 402*a* and the third sensor 402*c* continuously transmit the signal B to the determination unit 404. In this case, the determination unit 404 determines that the pitching operation lever 806 passes below the second sensor 402*b*. In this case, the pitching stick holder 807 does not pivot in the rightward-leftward direction. Accordingly, the determination unit 404 determines that the ball is pitched to the center of the strike zone in the horizontal direction.

In addition, in this case, the contact portion 809 of the pitching operation lever 806 comes into contact with the second surface portion 1402 located in the forward direction from the inner wall surface of the baseball game board main body 10 (Pattern 3). Accordingly, the movement amount of the pitching operation lever 806 in the rearward direction is larger than that in Pattern 2 described above, but is smaller than that in Pattern 1 described above. Therefore, the compression amount of the elastic member 808 is larger than that in Pattern 2 described above, but is smaller than that in Pattern 1 described above. As a result, the moving speed of the pitching operation lever 806 is faster than the moving speed of the pitching operation lever 806 in Pattern 2, but is slower than the moving speed of the pitching operation lever 806 in Pattern 1 described above. Therefore, the determination unit 404 classifies the ball speed as the medium speed. According to the present embodiment, the determination unit 404 controls the first display screen 401*a* to display 147 km/h. In addition, if the ball speed is classified as the medium speed, the determination unit 404 determines that the ball height is in the middle. As a result, the first display screen 401*a* displays a screen illustrated by (iii) in FIG. 12A.

The operator moves the adjustment knob 1403 until the adjustment knob 1403 comes into contact with the right end of the movement hole 31, and moves the pitching knob 802 to a substantially intermediate position between the center and the left side surface of the pitching operation hole 801. Thereafter, in a case where the pitching knob 802 is released, the pitching operation lever 806 passes below the second sensor 402*b* and the third sensor 402*c* as illustrated by (iv) in FIG. 12B. The second sensor 402*b* and the third sensor 402*c* transmit the electric signals to the determination unit 404 in the order of the signal B, the signal A, the signal B, and the signal A. On the other hand, the first sensor 402*a* continuously transmits the signal B to the determination unit 404. In this case, the determination unit 404 determines that the pitching operation lever 806 passes below the second sensor 402*b* and the third sensor 402*c*. In this case, the pitching stick holder 807 pivots approximately 2° in the rightward direction. Accordingly, the determination unit 404 determines that the ball is pitched to the right side ball zone in the horizontal direction.

In addition, in this case, the contact portion 809 of the pitching operation lever 806 does not come into contact with the plate-shaped member 14. Accordingly, the movement amount of the pitching operation lever 806 is maximized, and the compression amount of the elastic member 808 is also maximized (Pattern 1). As a result, the moving speed of the pitching operation lever 806 becomes faster than the moving speed of the pitching operation lever 806 in Pattern 2 and Pattern 3 described above. Accordingly, a time required for the third code 830*c* to pass below the second sensor 402*b* and the third sensor 402*c* is minimized. Therefore, the determination unit 404 classifies the ball speed as the high speed. According to the present embodiment, the determination unit 404 controls the first display screen 401*a* to display 152 km/h. In addition, if the ball speed is classified as the high speed, the determination unit 404 determines that the ball height is high. As a result, the first display screen 401*a* displays a screen illustrated by (iv) in FIG. 12A.

The operator moves the adjustment knob 1403 until the adjustment knob 1403 comes into contact with the right end of the movement hole 31, and pulls the pitching knob 802 rearward so as to come into contact with the left side surface of the pitching operation hole 801. Thereafter, in a case where the pitching knob 802 is released, the pitching operation lever 806 passes below the third sensor 402*c* as illustrated by (v) in FIG. 12B. The third sensor 402*c* transmits the electric signals to the determination unit 404 in the order of the signal B, the signal A, the signal B, and the signal A. On the other hand, the first sensor 402*a* and the second sensor 402*b* continuously transmit the signal B to the determination unit 404. In this case, the determination unit 404 determines that the pitching operation lever 806 passes below the third sensor 402*c*. In this case, the pitching stick holder 807 pivots approximately 5° in the rightward direction. Accordingly, the determination unit 404 determines that the ball is pitched to the right side ball zone in the horizontal direction.

In addition, in this case, the contact portion 809 of the pitching operation lever 806 does not come into contact with the plate-shaped member 14. Accordingly, the movement amount of the pitching operation lever 806 is maximized, and the compression amount of the elastic member 808 is also maximized (Pattern 1). Therefore, the determination unit 404 classifies the ball speed as the high speed. According to the present embodiment, the determination unit 404 controls the first display screen 401*a* to display 155 km/h. In addition, if the ball speed is classified as the high speed, the determination unit 404 determines that the ball height is high. As a result, the first display screen 401*a* displays a screen illustrated by (v) in FIG. 12A.

In describing the passing position of the above-described pitching operation lever 806, an operation has been described in which the pitching knob 802 is pulled rearward after the position of the pitching knob 802 is determined. However, the position of the pitching knob 802 may be moved after the pitching knob 802 is pulled rearward.

Figure 13A:
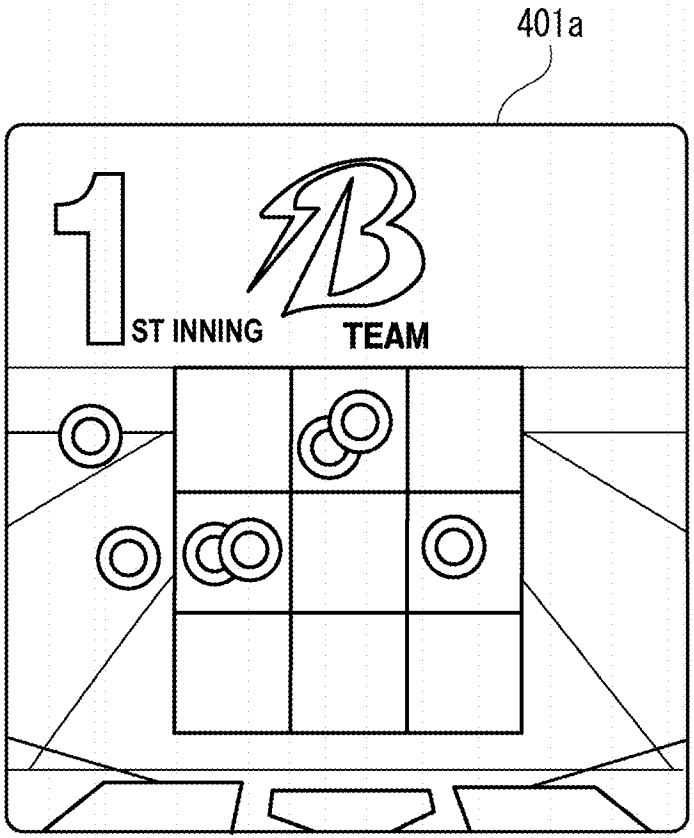
FIG. 13A is a view illustrating the first display screen in a state where a history of pitching results is displayed.
Figure 13B:
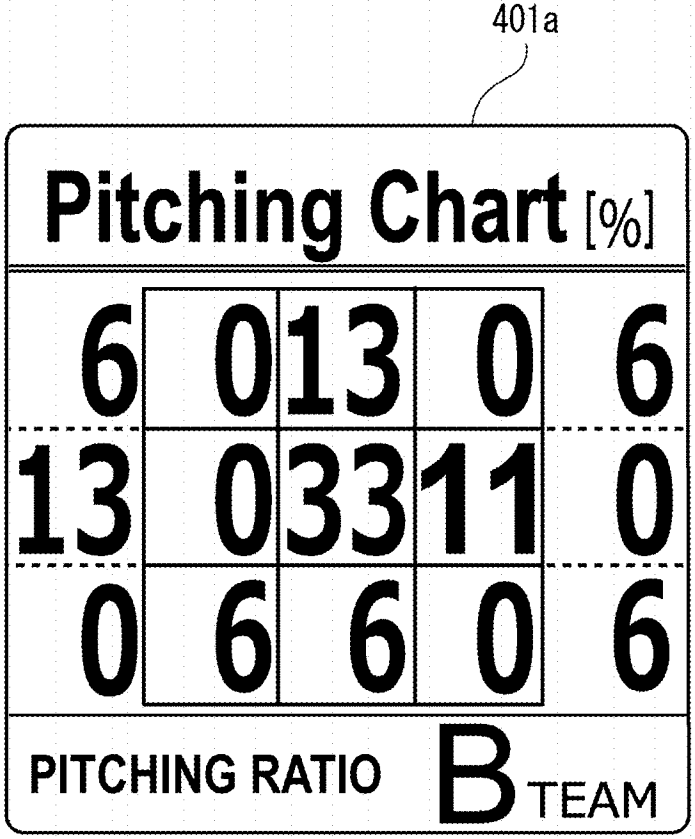
FIG. 13B is a view illustrating the first display screen in a state where a ratio of pitching positions is displayed.

Referring to FIGS. 13A and 13B, a pitching history display function will be described. FIG. 13A is a view illustrating a first display screen 401*a* in a state where a history of a pitching result is displayed. The operator presses down the operation button 405 for displaying the pitching result on the first display screen 401*a*. Then, the electric signal associated with the operation button 405 pressed down is transmitted to the determination unit 404. Based on the electric signal, the determination unit 404 controls the first display screen 401*a* to display the number of innings, and to display one ball by one ball in a pitching course of the pitched ball in the corresponding inning at a predetermined time interval. It is preferable that the time interval is approximately 0.2 seconds. However, the time interval may be longer, or may be shorter. In addition, a portion where the balls overlap each other is displayed so that the subsequently pitched ball is located above the previously pitched ball. For example, in a case where seven balls are pitched in a certain inning, the history of the pitching result as illustrated in FIG. 13A is displayed on the first display screen 401*a*.

FIG. 13B is a view illustrating the first display screen 401*a* in a state where a ratio of pitching positions is displayed. The operator presses down the operation button 405 for displaying the ratio of the pitching positions on the first display screen 401*a*. Then, the electric signal associated with the operation button 405 pressed down is transmitted to the determination unit 404. Based on the electric signal, the determination unit 404 controls the first display screen 401*a* so that the pitching positions of the pitched balls received so far by a batting team within a game is proportionally displayed for each pitching course. As a result, the first display screen 401*a* displays a screen as illustrated in FIG. 13B.

For example, the ratio is displayed in percentage. In addition, according to the present embodiment, one digit or two digits can be displayed per one square block. Therefore, in a case where the number of the pitched ball is one ball, the ratio of the pitching positions is displayed as 99. In addition, in a case where the ratio is a decimal point, a number obtained by rounding off the decimal point is displayed on the first display screen 401*a*. Therefore, the sum of the numbers displayed on the first display screen 401*a* is not necessarily one hundred. One digit or two digit number can be displayed per one square block. However, a configuration may be adopted in which three digit numbers can be displayed.

According to this configuration, the display unit displays the pitching course determined by the determination unit 404. Therefore, the operator on the pitching side confirms the pitching course displayed on the display unit, thereby enabling the operator on the pitching side to confirm whether or not the ball can be pitched to his or her targeted course. The operator who confirms the pitching course confirms the pitching course obtained through the previous operation. In this manner, the operator is likely to devise an operation for subsequent pitching, and is likely to utilize various pitching functions. In this way, according to this configuration, it is possible to provide the baseball game board which enables the operator to fully enjoy the game using various pitching functions.

In addition, according to this configuration, a simple configuration can achieve an additional function to accurately determine the pitching course for each pitching time.

In addition, according to this configuration, for example, the operators can play a game for competing whether or not the ball can be pitched to all courses or a designated course out of the pitching courses inside the strike zone respectively divided into three in the vertical direction and the horizontal direction. Therefore, the operator can fully enjoy the game using various pitching functions.

According to the embodiments of the present invention as described above, it is possible to provide the baseball game board according to the following embodiment.

In a first aspect, there is provided a baseball game board including: a main body unit simulating a baseball stadium and including an upper surface plate; a pitching unit configured to pitch a ball to allow the ball to move while floating in air; a batting unit configured to hit the ball; and a selection unit configured to gradationally select a ball height of the ball at a time of passing through the batting unit, wherein in accordance with a selection result of the selection unit, a trajectory of the ball shot from the pitching unit is changed.

According to this configuration, when the operator pitches the ball such that the ball moves while floating in the air, the operator operates the selection unit in advance. In this manner, the operator can select the ball height of the ball at a time of passing through the batting unit. In accordance with the selection result of the selection unit, the trajectory of the ball shot from the pitching unit is changed. For example, the operation on the selection unit can be gradationally selected from among the high ball, the middle ball, and the low ball. The operation does not require balanced adjustment of the operator. Accordingly, the operation for determining the ball height can be more satisfactorily reproduced. In this way, according to the above-described configuration, even a beginner can easily enjoy various pitching functions.

In a second aspect, there is provided the baseball game board according to the first aspect, further including: a pitching operation unit configured to perform a pitching operation; and a pitching operation lever having an elongated shape and located in the pitching operation unit so as to shoot the ball from the pitching unit, wherein the selection unit adjusts a maximum movement amount of the pitching operation lever to be pulled along an axial direction of the pitching operation lever when the pitching operation is performed.

According to this configuration, by operating the selection unit, the operator can adjust the maximum movement amount of the pitching operation lever to be pulled. Therefore, after the operator operates the selection unit, the operator pulls the pitching operation lever up to a position where the pitching operation lever can be pulled, and releases the pitching operation lever. In this manner, the operator enables the pitching unit to easily pitch the ball by using the height selected by the selection unit.

In a third aspect, there is provided the baseball game board according to the second aspect, wherein the selection unit includes a plate-shaped member, wherein the plate-shaped member includes a first surface portion and a second surface portion on a surface facing the pitching unit, wherein a thickness of the first surface portion in the axial direction of the pitching operation lever is larger than that of the second surface portion, and wherein the pitching operation lever includes a contact portion allowed to contact the first surface portion and the second surface portion.

According to this configuration, a difference between the thickness of the first surface portion of the plate-shaped member and the thickness of the second surface portion is utilized. In this manner, it is possible to adjust the maximum movement amount which enables the operator to pull the pitching operation lever.

In a fourth aspect, there is the baseball game board according to the third aspect, the plate-shaped member has a cutout portion which is larger than the contact portion when the plate-shaped member is viewed along the axial direction of the pitching operation lever.

According to this configuration, the operator performs the operation of locating the plate-shaped member (selection unit) so that the contact portion of the pitching operation lever passes through the cutout portion. In this manner, the operator can maximize the movement amount which enables the operator to pull the pitching operation lever.

The present invention is not limited to the above-described embodiment, and can be appropriately modified or improved. In addition, without being particularly limited, a material, a shape, a size, a numerical value, a form, a number, and an arrangement place of the respective configuration elements in the above-described embodiment may be optionally adopted as long as the present invention can be achieved.

In the above-described embodiment, there are the steps in the boundary between the first surface portion 1401 and the second surface portion 1402 and in the boundary between the second surface portion 1402 and the third surface portion 1405. The step has the right-angled stepped shape, but the step is not limited to this example. For example, the step may be inclined.

In the above-described embodiment, the three sensors are disposed in the lower portion of the centerfield screen 4, but the present invention is not limited to this example. For example, five sensors may be disposed therein.

In the above-described embodiment, the pitching course frame has a total of 15 square blocks including three vertical rows and five horizontal columns, and the strike zone has a total of nine square blocks including three vertical rows and three columns at the center in the horizontal direction. However, the present invention is not limited to this example. For example, the pitching course frame may be divided into a total of 21 square blocks including three vertical rows and seven horizontal columns, or the strike zone may be divided into a total of 15 square blocks including three vertical rows and five columns at the center in the horizontal direction.

The invention claimed is:

1. A baseball game board comprising:

a main body unit simulating a baseball stadium and comprising an upper surface plate;

a pitching unit located at a substantially central position of the upper surface plate, the pitching unit including a shooting hole located in the upper surface plate and configured to shoot a ball in a substantially forward direction with respect to an orientation of the pitching unit on the upper surface plate;

a batting unit located on the upper surface plate in the forward direction from the pitching unit; and a selection unit located in a rearward direction of the pitching unit, the selection unit including a plate-shaped member having a surface facing the pitching unit and operable to gradationally select a ball height of the ball at a time of the ball passing through the batting unit, wherein in accordance with a selection result of the selection unit, a trajectory of the ball shot from the pitching unit is changed.

2. The baseball game board according to claim 1, further comprising:

a pitching operation unit located in the rearward direction of the pitching unit and formed outside the upper surface plate, the pitching operation unit including a pitching operation lever having an elongated shape and operable to cause the ball to shoot out from the shooting hole of the pitching unit, wherein the selection unit is configured to adjust a maximum movement amount of the pitching operation lever to be pulled along an axial direction of the pitching operation lever when the pitching operation lever is operated to cause the ball to shoot out from the pitching unit.

3. The baseball game board according to claim 2, wherein the surface of the plate-shaped member facing the pitching unit comprises a first surface portion and a second surface portion adjacent to the first surface portion, wherein a thickness of the first surface portion in the axial direction of the pitching operation lever is larger than that of the second surface portion such that a boundary between the first surface portion and the second surface portion has a step in a thickness direction of the plate-shaped member, and wherein the pitching operation lever comprises a contact portion allowed to contact the first surface portion and the second surface portion.

4. The baseball game board according to claim 3, wherein the plate-shaped member has a cutout portion which is larger than the contact portion of the pitching operation lever when the plate-shaped member is viewed along the axial direction of the pitching operation lever.

* * * * *